US010363763B2

(12) United States Patent
Misawa

(10) Patent No.: US 10,363,763 B2
(45) Date of Patent: Jul. 30, 2019

(54) COVER PIECE AND MEDIUM STORAGE CASSETTE

(71) Applicant: SEIKO EPSON CORPORATION, Tokyo (JP)

(72) Inventor: Yuji Misawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/913,229

(22) Filed: Mar. 6, 2018

(65) Prior Publication Data

US 2018/0272772 A1 Sep. 27, 2018

(30) Foreign Application Priority Data

Mar. 23, 2017 (JP) ..... 2017-057155

(51) Int. Cl.

| | |
|---|---|
| ***B41J 29/13*** | (2006.01) |
| ***B41J 29/56*** | (2006.01) |
| ***B41J 29/02*** | (2006.01) |
| ***B41J 13/10*** | (2006.01) |

(52) U.S. Cl.

CPC ..... *B41J 29/13* (2013.01); *B41J 13/103* (2013.01); *B41J 29/02* (2013.01); *B41J 29/56* (2013.01)

(58) Field of Classification Search

CPC ..... B41J 15/042; B41J 29/13; B41J 13/103; B41J 29/02; B41J 29/56

See application file for complete search history.

(56) References Cited

U.S. PATENT DOCUMENTS

2007/0177915 A1 8/2007 Motoyoshi

FOREIGN PATENT DOCUMENTS

| | | | | |
|---|---|---|---|---|
| JP | 2000-104427 A | | 4/2000 | |
| JP | 2006-257822 A | | 9/2006 | |
| JP | 2007-204170 A | | 8/2007 | |
| JP | 2009-120399 | * | 6/2009 | ..... B65H 1/12 |
| JP | 2009-120399 A | | 6/2009 | |

* cited by examiner

*Primary Examiner* — Henok D Legesse
(74) *Attorney, Agent, or Firm* — Workman Nydegger

(57) ABSTRACT

Provided is a cover piece to be removably attached to a medium storage cassette including a medium storage section for storing a medium, and an operation unit provided in a recess and configured to lock and unlock the medium storage section to and from an apparatus main body. The cover piece includes a main portion configured to enter the recess in the medium storage cassette so as to cover the recess, and a sliding portion configured to slide so as to switch between a first state in which the sliding portion sticks out from the main portion and the main portion is locked to the recess, and a second state in which the main portion is unlocked and allowed to enter the recess and be removed from the recess.

11 Claims, 21 Drawing Sheets

COVER PIECE AND MEDIUM STORAGE CASSETTE

CROSS REFERENCES TO RELATED APPLICATIONS

The entire disclosure of Japanese Patent Application No. 2017-057155, filed Mar. 23, 2017 is expressly incorporated by reference herein.

BACKGROUND

1. Technical Field

The present disclosure relates to a cover piece to be removably attached to a medium storage cassette for storing a medium, and the medium storage cassette with the cover piece.

2. Related Art

In recording apparatuses, typically exemplified by a printer and a copier, paper cassettes removably mounted in the apparatus main body are widely employed.

Many of the paper cassettes include a holding portion provided in the front face, so that a user holds the holding portion and draws out the paper cassette, to the side of the user.

JP-A-2007-204170 discloses a paper cassette including a first holding portion to be held from an upper side and a second holding portion to be held from a lower side, so that the user can engage the fingers with whichever is easier to draw out the paper cassette, in view of the drawback of conventional paper cassettes in that the holding portion is formed so as to be held by the fingers from the lower side, and hence the user has to crouch down to draw out the paper cassette, which is a burden to the user.

Now, in some recording apparatuses a locking device is provided for locking the paper cassette mounted in the apparatus main body, and an operation lever for unlocking the locking device is provided on the paper cassette.

Regarding the recording apparatuses configured as above, there has arisen a demand for prevention of inadvertent removal of the paper cassette. To satisfy such a demand, the apparatus main body and the paper cassette may be connected, for example with a padlock. In this case, however, a hook (projection) for passing the padlock has to be formed on both of the apparatus main body and the paper cassette, which leads to an increase in dimensions of the apparatus, as well as to impaired appearance thereof.

SUMMARY

An advantage of some aspects of the disclosure is prevention of inadvertent removal of the paper cassette, without incurring an increase in dimensions of the corresponding apparatus.

In an aspect, the disclosure provides a cover piece to be removably attached to a medium storage cassette including a medium storage section for storing a medium, and an operation unit provided in a recess and configured to lock and unlock the medium storage section to and from an apparatus main body. The cover piece includes a main portion configured to enter the recess in the medium storage cassette so as to cover the recess, and a sliding portion configured to slide so as to switch between a first state in which the sliding portion sticks out from the main portion and the main portion is locked to the recess, and a second state in which the main portion is unlocked and allowed to enter the recess and be removed from the recess.

The mentioned cover piece, to be removably attached to the medium storage cassette including the operation unit configured to switch between the locked state and the unlocked state with respect to the apparatus main body, includes the main portion configured to enter the recess in which the operation unit is provided, so as to cover the recess, and the sliding portion configured to lock the main portion to the recess. Thus, the movement of the operation unit for unlocking is restricted when the main portion enters the recess, and therefore inadvertent removal of the medium storage cassette can be prevented, without an increase in dimensions of the corresponding apparatus.

In addition, the sliding portion is configured to slide so as to switch between the first state and the second state. The sliding movement requires a smaller space for switching the state, compared with, for example, a pivoting movement.

In the cover piece configured as above, the first state of the sliding portion may be realized when a tip portion of the sliding portion is engaged with an engaging hole formed inside the recess.

In this case, the first state of the sliding portion is realized when the tip portion of the sliding portion is engaged with the engaging hole formed inside the recess. Therefore, the main portion can be securely locked to the recess.

In the cover piece configured as above, the sliding portion may switch between the first state and the second state, by sliding in a width direction of the medium storage cassette in the recess.

The mentioned configuration that the sliding portion switches between the first state and the second state, by sliding in the width direction of the medium storage cassette in the recess, provides the same advantageous effect as described above.

Here, the width direction of the medium storage cassette in the recess means a direction intersecting the vertical direction.

The cover piece configured as above may include a press button that can be displaced in a depth direction of the recess, and the sliding portion may switch the second state to the first state, when the press button is pressed.

In this case, since the cover piece includes the press button that can be displaced in the depth direction of the recess, and the sliding portion switches the second state to the first state when the press button is pressed, the second state can be easily switched to the first state, with a simple operation.

The cover piece configured as above may include an opening for receiving a key member, and the sliding portion may switch the first state to the second state, when the key member is inserted in the opening.

In this case, since the cover piece includes the opening for receiving a key member, and the sliding portion switches the first state to the second state when the key member is inserted in the opening, the first state can be easily switched to the second state, with a simple operation.

In the cover piece configured as above, the operation unit may be restricted from being displaced in the recess, when the main portion is in the recess, and the sliding portion is set to the first state.

In this case, since the operation unit is restricted from being displaced in the recess, when the main portion is in the recess, and the sliding portion is set to the first state, the medium storage cassette is prevented from being accidentally unlocked from the apparatus main body, owing to vibration or an impact.

In the cover piece configured as above, the operation unit may include an upper holding portion located on an inner side of the recess and on an upper side thereof, a lower holding portion located on the inner side of the recess and on a lower side thereof, and an intermediate portion connecting the upper holding portion and the lower holding portion, and the operation unit may be restricted from being displaced when the tip portion of the sliding portion enters a restriction hole formed in the intermediate portion.

In this case, since the operation unit includes the upper holding portion located on the inner side of the recess and on the upper side thereof, and the lower holding portion located on the inner side of the recess and on the lower side thereof, the user can switch the state of the locking device by operating whichever of the upper holding portion and the lower holding portion, which leads to improved user-friendliness.

Moreover, the operation unit is restricted from being displaced, when the tip portion of the sliding portion enters the restriction hole formed in the intermediate portion, connecting the upper holding portion and the lower holding portion. Therefore, the upper holding portion or the lower holding portion can be operated more comfortably, compared with the configuration in which the restriction hole in which tip portion of the sliding portion enters is formed in either of the upper holding portion and the lower holding portion.

In the cover piece configured as above, the recess may be formed in a front face of the medium storage cassette, on a forward side in a direction in which the medium storage cassette is drawn out from the apparatus main body, the main portion may include a panel portion formed on a front side of the medium storage cassette in a shape and size that accord with an inner contour of the recess, and a surface of the panel portion and the front face of the medium storage cassette may become flush with each other, when the main portion covers the recess.

In this case, the surface of the panel portion and the front face of the medium storage cassette become flush with each other, when the main portion covers the recess. Therefore, the appearance of the medium storage cassette can be improved, and an increase in size of the medium storage cassette can be prevented, despite the cover piece being attached to the medium storage cassette.

In another aspect, the disclosure provides a medium storage cassette including a medium storage section for storing a medium, an operation unit configured to lock and unlock the medium storage section to and from an apparatus main body, a recess in which the operation unit is located, and a cover piece including a main portion configured to enter the recess so as to cover the recess, and a sliding portion configured to slide so as to switch between a first state in which the sliding portion sticks out from the main portion and locks the main portion to the recess, and a second state in which the sliding portion unlocks the main portion so as to allow the main portion to enter the recess and to be removed from the recess.

The mentioned medium storage cassette provides the same advantageous effects as described above.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Hereafter, an embodiment of the disclosure will be described with reference to the drawings, on the premise that the disclosure may be modified in various manners within the scope of the disclosure defined in the appended claims, without limitation to the following embodiment, and that such modifications are duly included in the scope of the disclosure.

Figure 1:
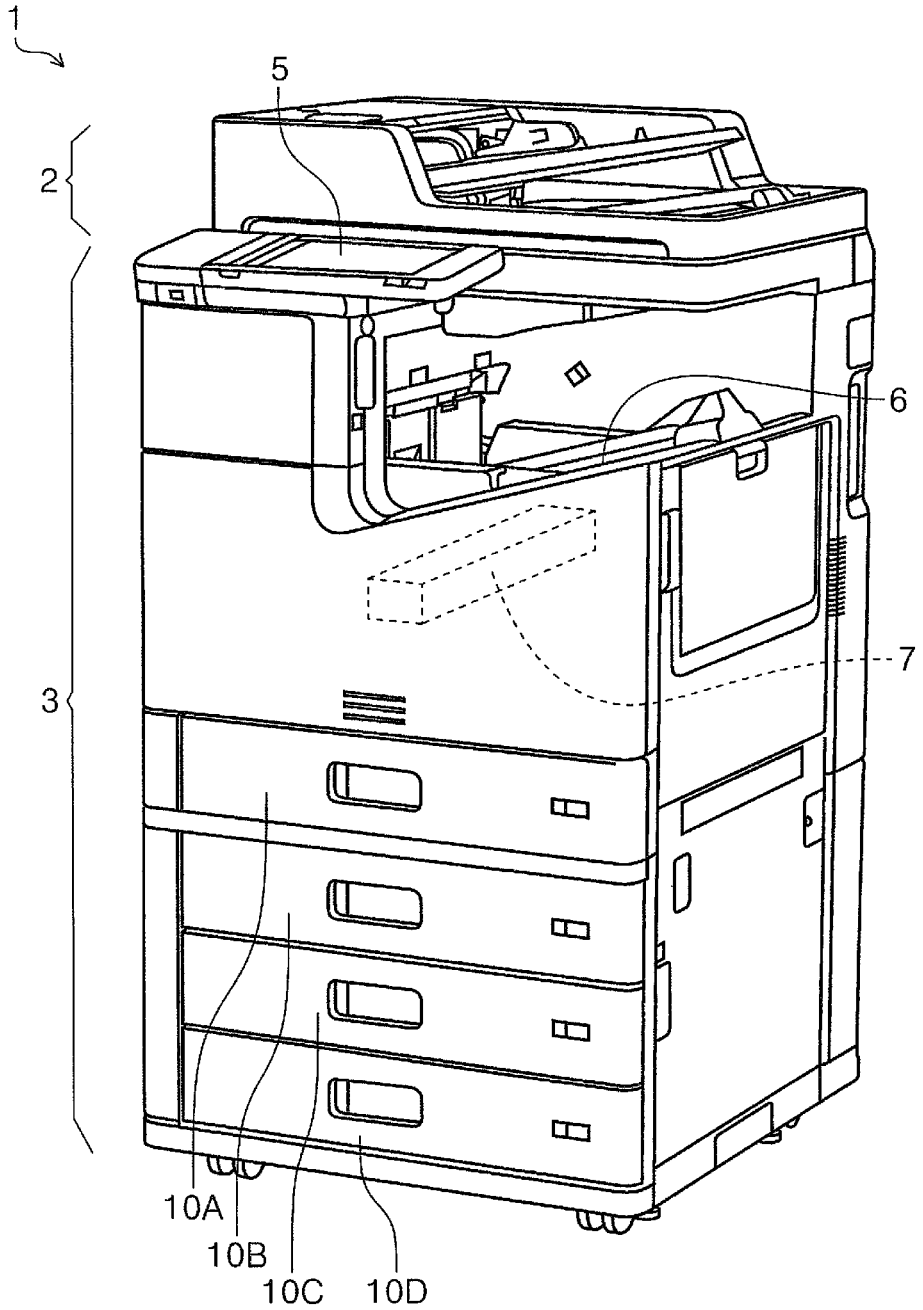
FIG. 1 is a perspective view showing the appearance of an ink jet printer according to an embodiment of the disclosure.
Figure 2:
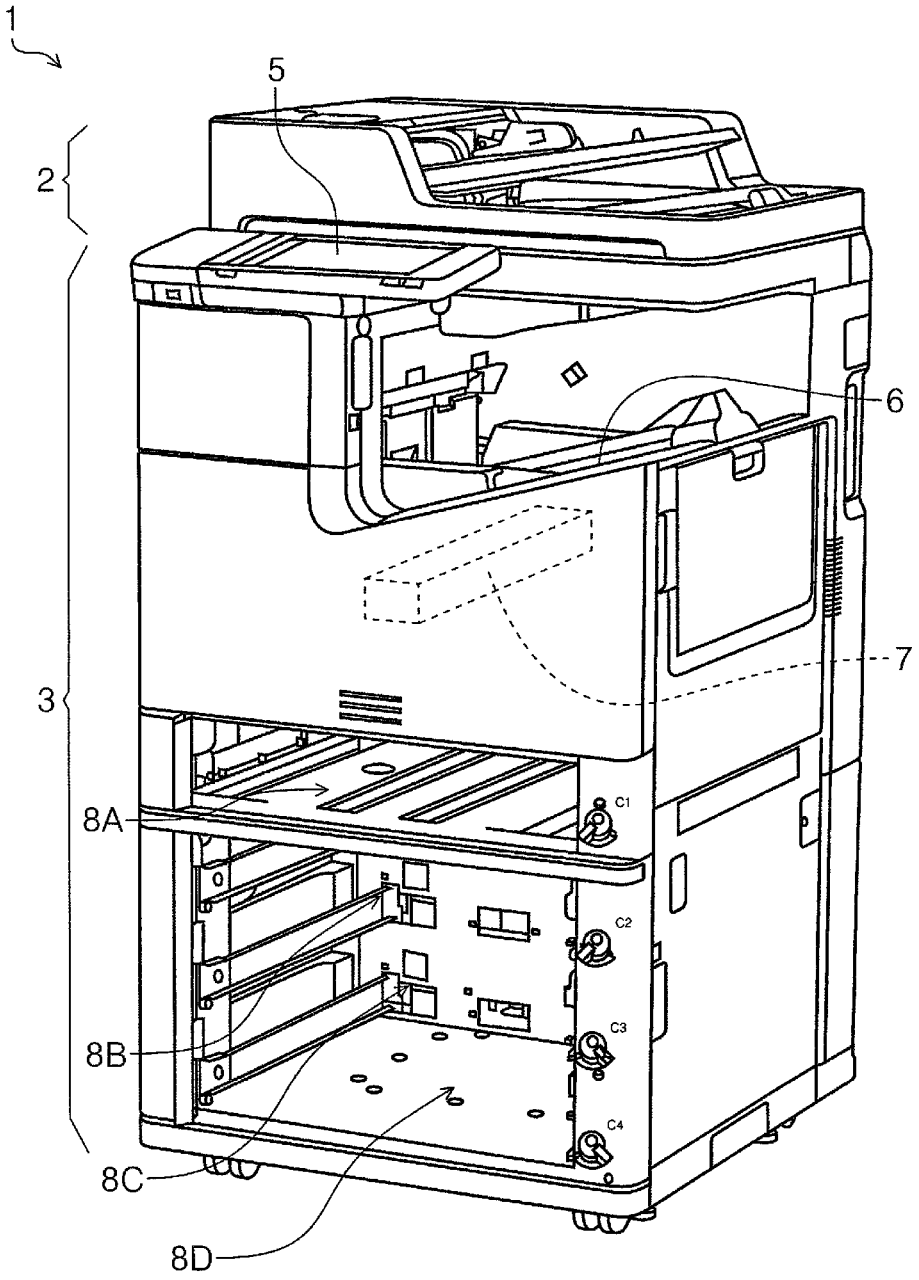
FIG. 2 is a perspective view showing the appearance of the ink jet printer according to the disclosure the disclosure, with paper cassettes removed.
Figure 3:
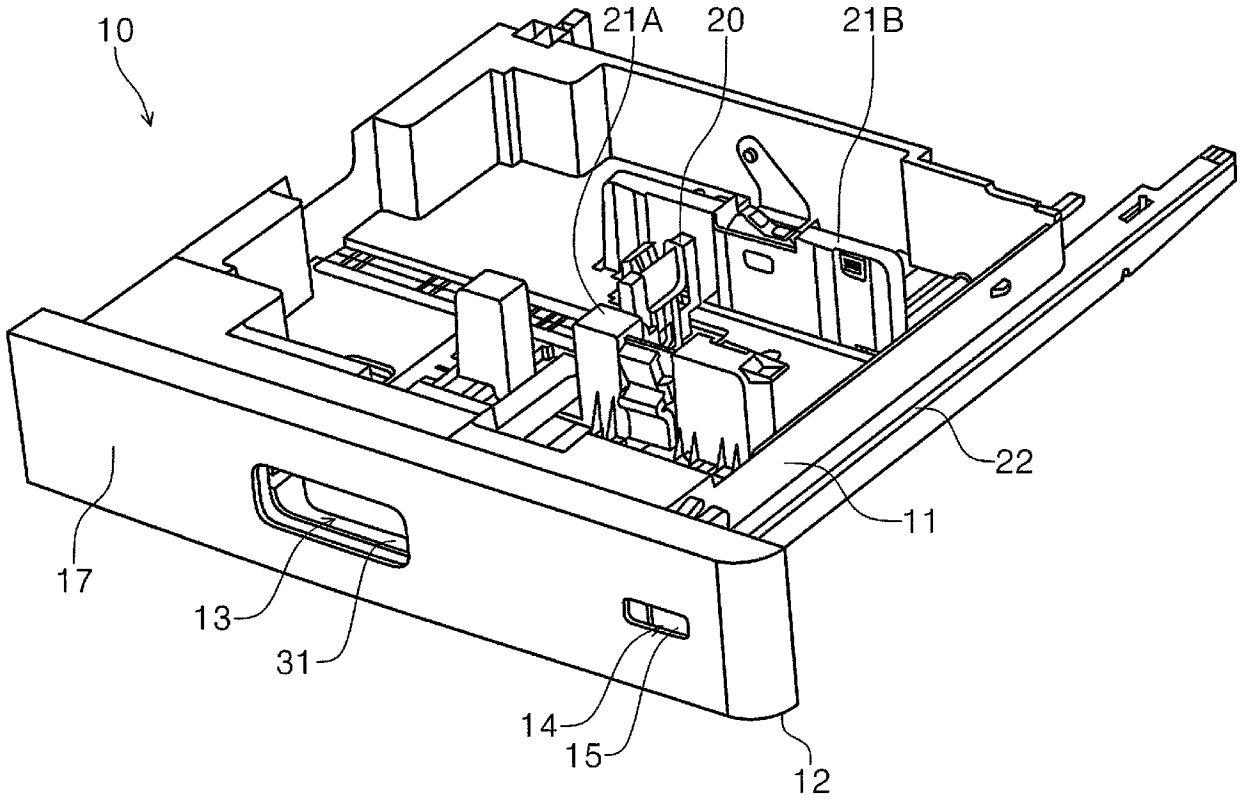
FIG. 3 is a perspective view of the paper cassette, from the front side.
Figure 4:
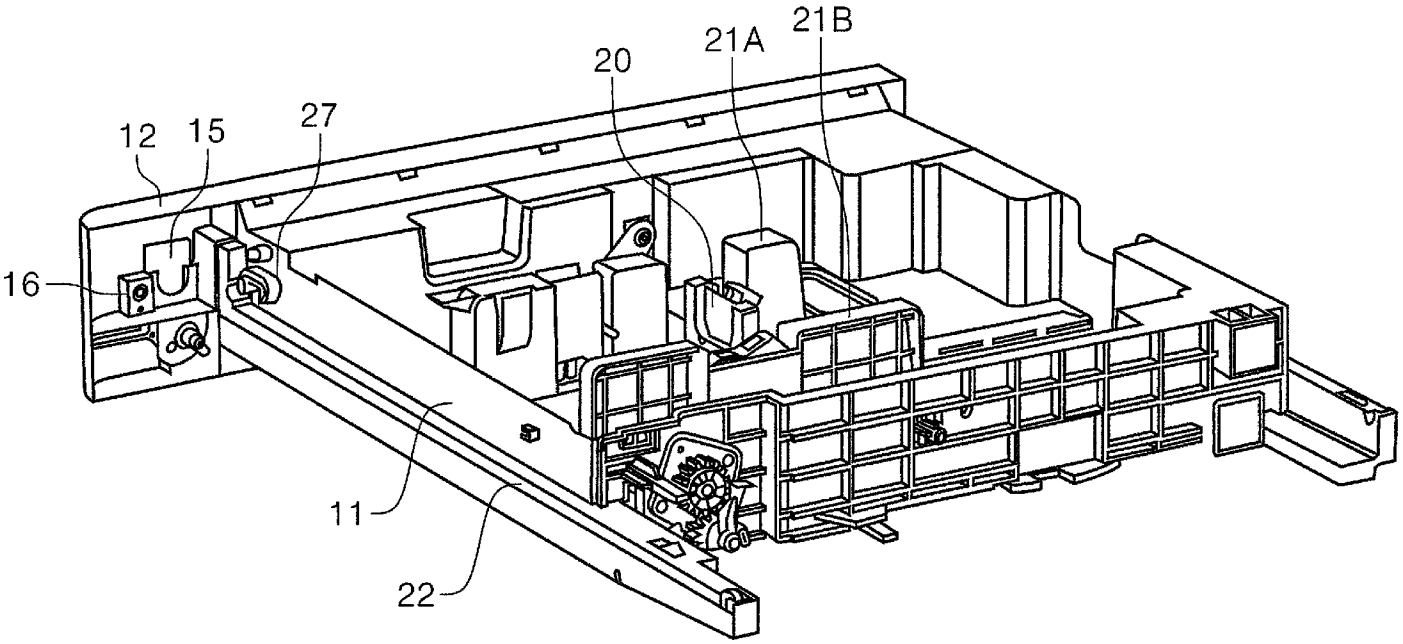
FIG. 4 is a perspective view of the paper cassette, from the rear side.

FIG. 1 is a perspective view showing the appearance of an ink jet printer (hereinafter, printer) according to an embodiment of the disclosure. FIG. 2 is a perspective view showing the same appearance of the ink jet printer, but with paper cassettes removed. FIG. 3 is a perspective view of the paper cassette, from the front side. FIG. 4 is a perspective view of the paper cassette, from the rear side.

Figure 5:
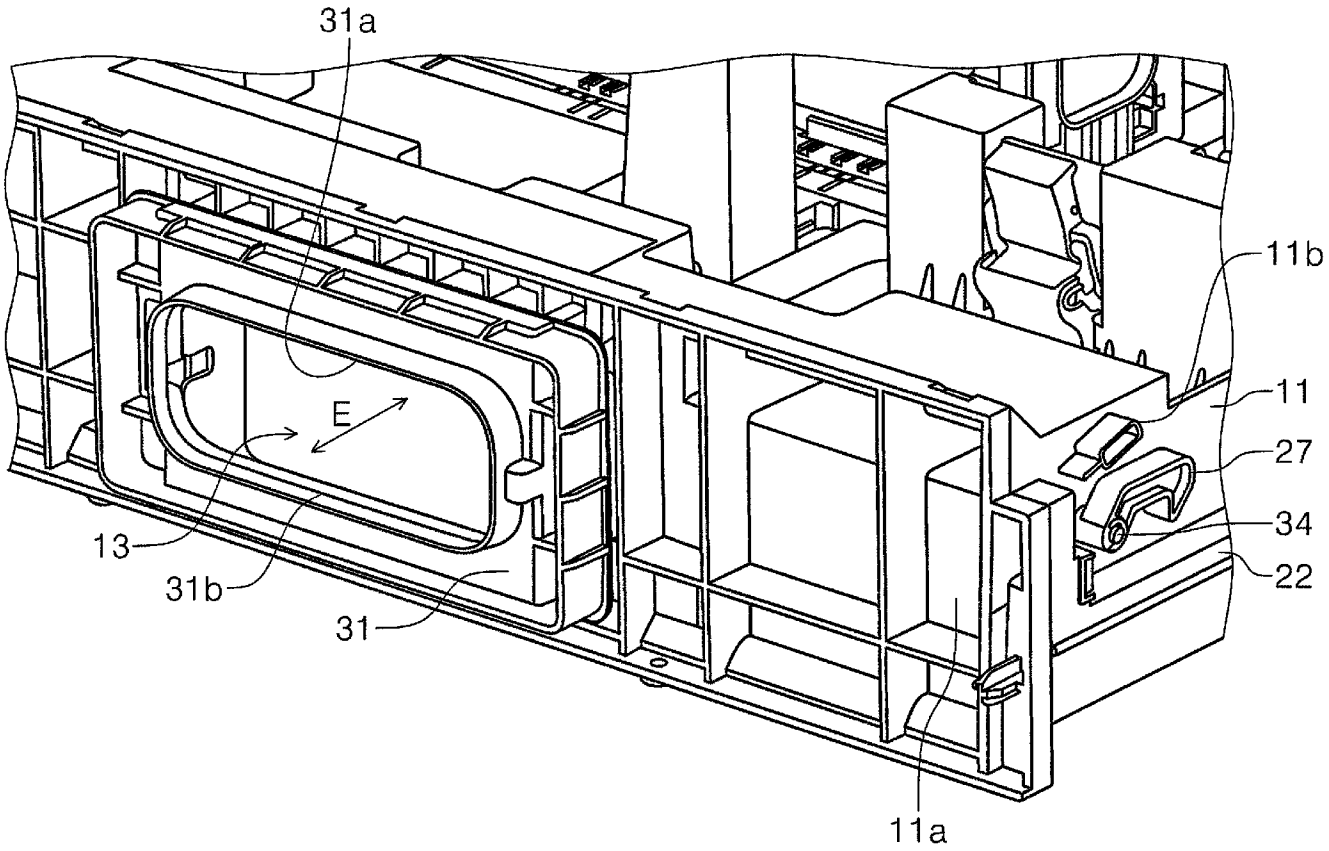
FIG. 5 is a perspective view of the paper cassette, with the front panel removed.
Figure 6:
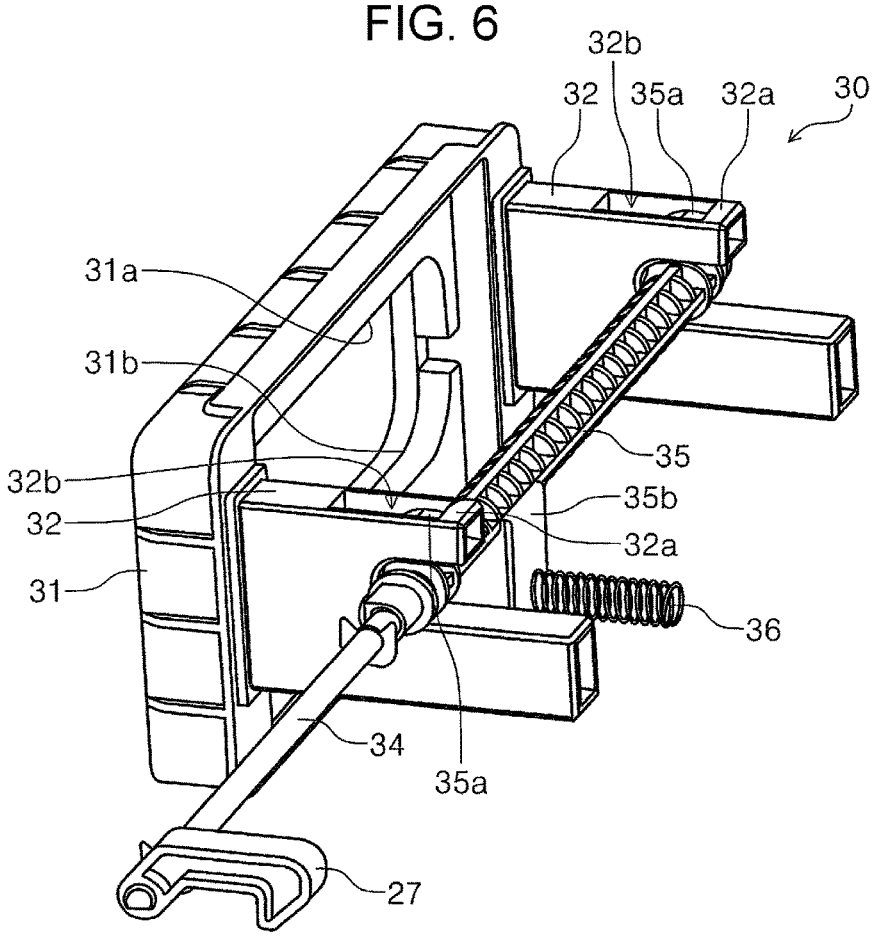
FIG. 6 is a perspective view of an operation lever and a conversion mechanism.
Figure 8:
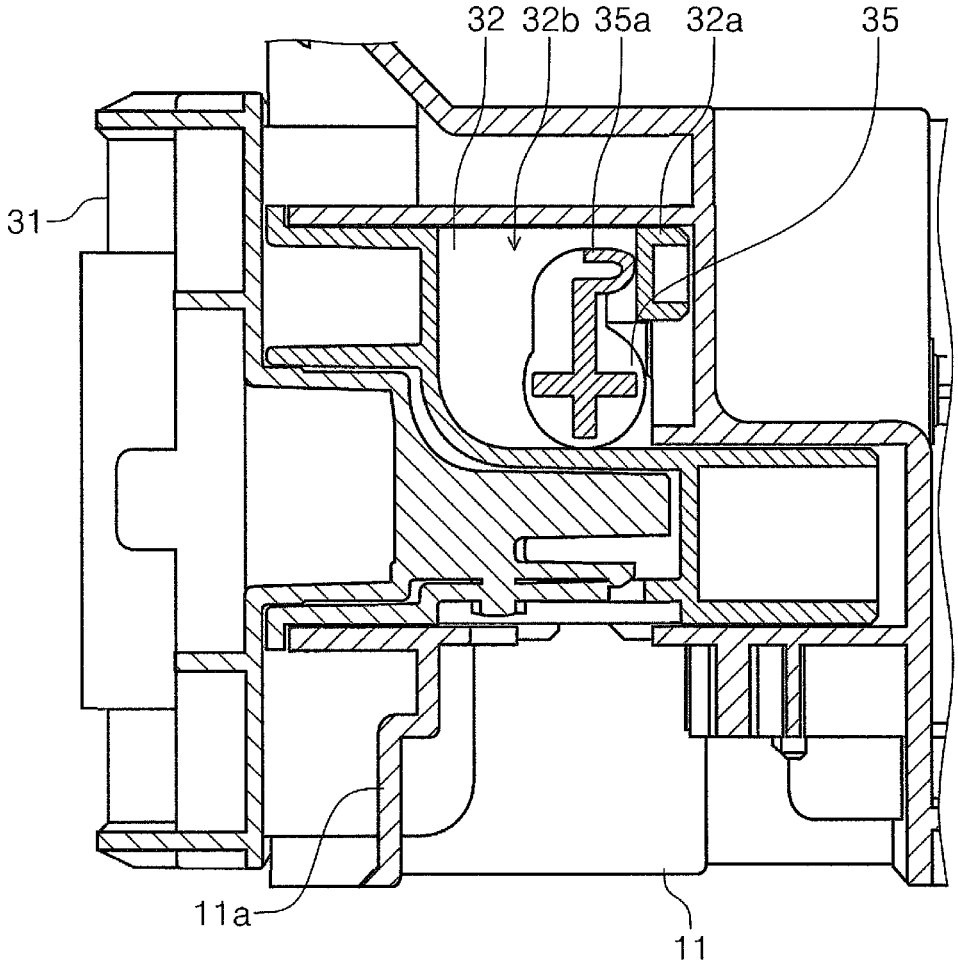
FIG. 8 is a cross-sectional view of the operation lever and the conversion mechanism.
Figure 9:
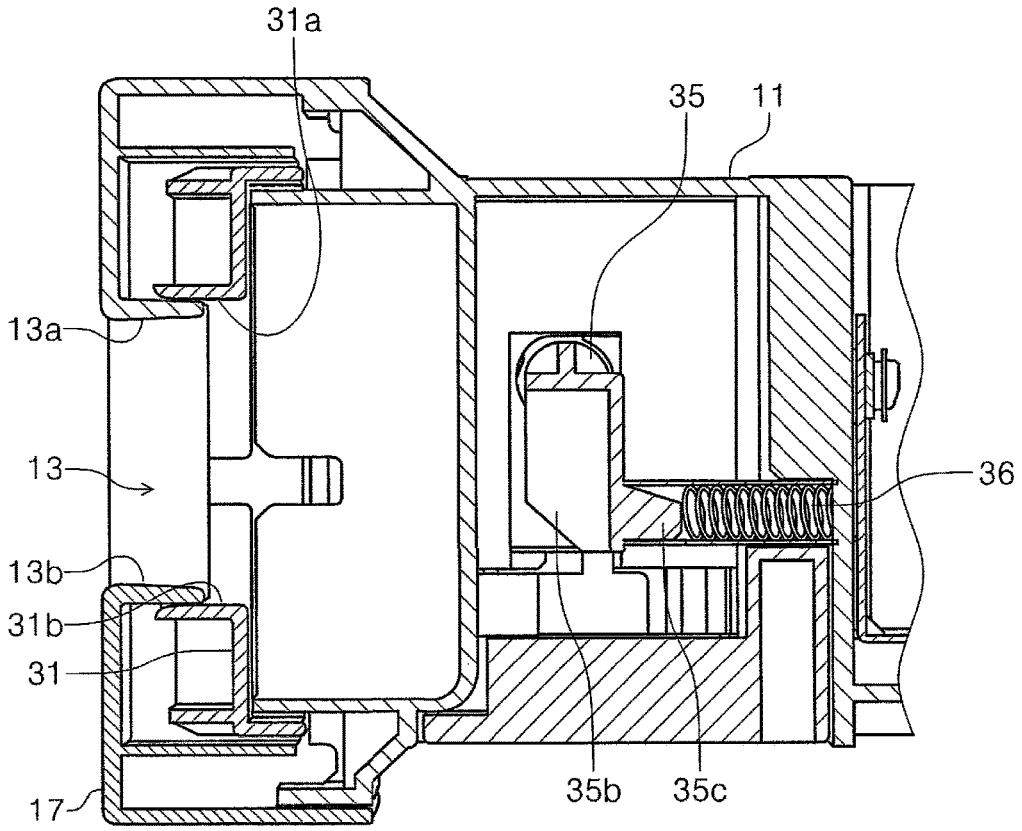
FIG. 9 is a cross-sectional view of the operation lever and the conversion mechanism.
Figure 10:
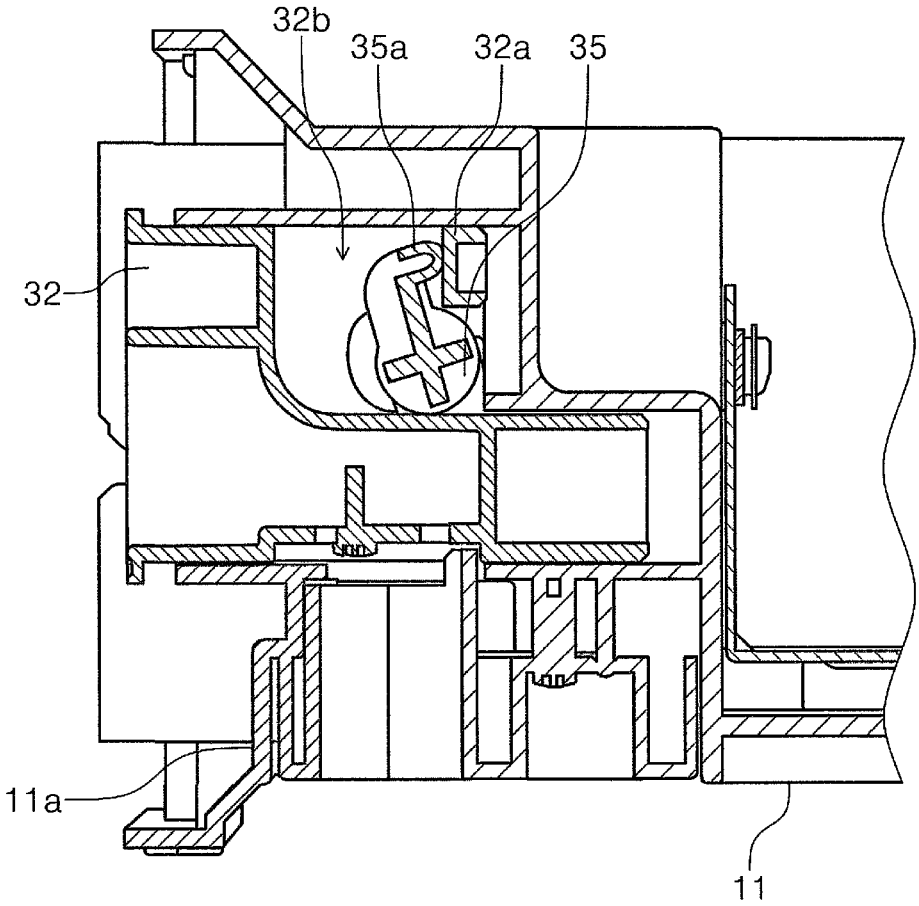
FIG. 10 is a cross-sectional view of the operation lever and the conversion mechanism.
Figure 11:
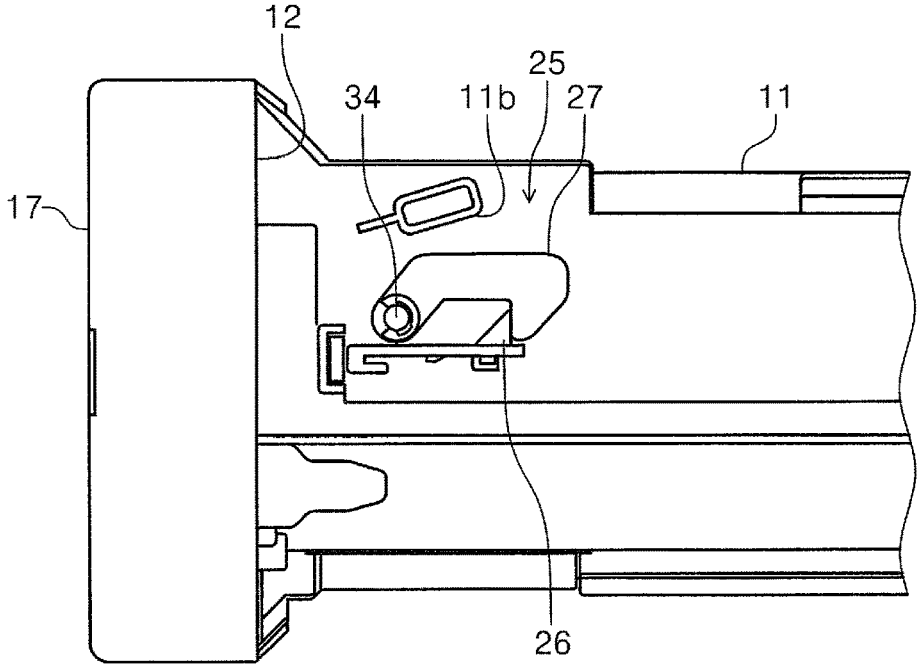
FIG. 11 is a partial side view showing an essential part of the paper cassette.
Figure 12:
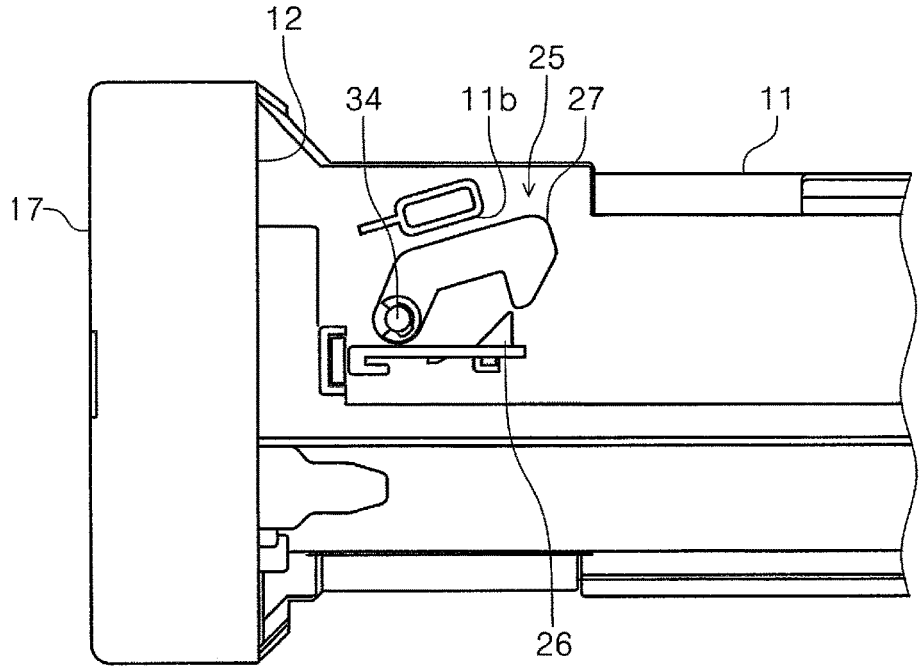
FIG. 12 is a partial side view showing the essential part of the paper cassette.
Figure 13:
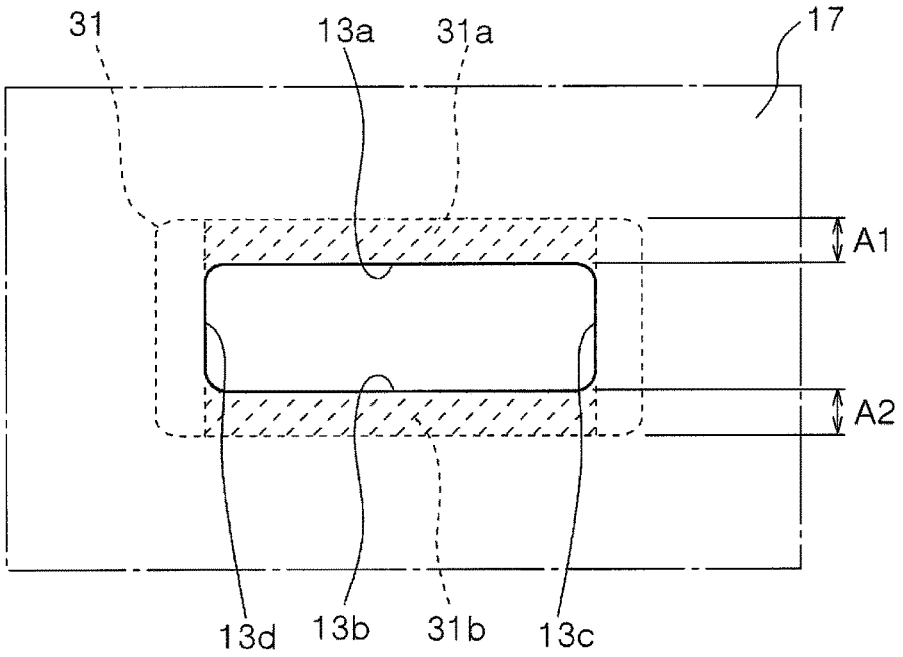
FIG. 13 is a front view of a holding recess.

FIG. 5 is a perspective view of the paper cassette, with the front panel removed. FIG. 6 is a perspective view of an operation lever and a conversion mechanism. FIG. 8, FIG. 9, and FIG. 10 are cross-sectional views of the operation lever and the conversion mechanism. FIG. 11 and FIG. 12 are partial side views each showing an essential part of the paper cassette. FIG. 13 is a front view of a holding recess.

Figure 14:
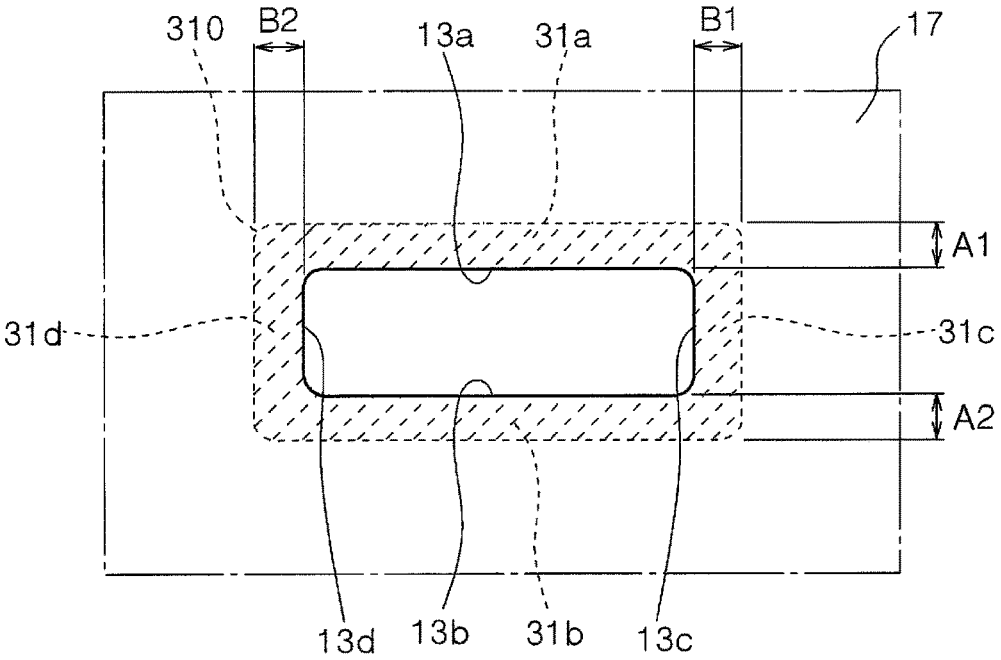
FIG. 14 is a front view of a holding recess according to a variation of the embodiment.

Further, FIG. 14 is a front view of a holding recess according to a variation of the embodiment.

Referring to FIG. 1 and FIG. 2, a general configuration of a printer 1 that performs ink jet recording on a recording sheet, exemplifying the medium in the disclosure, will be described hereunder.

As shown in FIG. 1 and FIG. 2, the printer 1 is generally composed of a scanner unit 2 and an apparatus main body 3. The apparatus main body 3 includes a non-illustrated transport route along which the recording sheet is transported, and a recording head 7 to be subsequently described. In this embodiment, the apparatus main body 3 includes four paper cassettes 10A, 10B, 10C, and 10D removably mounted therein, as examples of the medium storage cassette. In FIG. 2, reference numerals 8A, 8B, 8C, and 8D denote cassette compartments, in which the paper cassettes 10A, 10B, 10C, and 10D are respectively accommodated.

A numeral 5 denotes an operation panel located on the near side of the printer 1, to be used for operating the printer 1. A numeral 6 denotes a tray for receiving the recording sheet that has undergone the printing and is discharged, and more specifically a face-down discharge tray for receiving the recording sheet discharged with the surface that has just been printed oriented downward.

A numeral 7 denotes a recording head (line head), including nozzles that eject ink aligned over the entire width of the recording sheet, so as to perform the printing over the entire width of the recording sheet, without moving in the width direction.

In this embodiment, the depth direction of the printer 1 corresponds to the width direction of the recording sheet, and the width direction of the printer 1 corresponds to the direction in which the recording sheet is fed, transported, and discharged.

Hereunder, a configuration of the paper cassette 10 will be described. In the following description, the cassette compartments 8A, 8B, 8C, and 8D will be collectively referred to as cassette compartment 8, when specific distinction is unnecessary. Likewise, the paper cassettes 10A, 10B, 10C, and 10D will be collectively referred to as paper cassette 10, when specific distinction is unnecessary.

Referring to FIG. 3 and FIG. 4, a numeral 11 denotes a paper storage section, exemplifying the medium storage section in the disclosure, for storing the recording sheet, exemplifying the medium in the disclosure, in the paper cassette 10. A numeral 22 denotes a protruding portion extending in the direction in which the paper cassette 10 is mounted and removed (depth direction of the printer 1). The protruding portion 22 is guided along a non-illustrated guide rail provided on the cassette compartment 8. Although the protruding portion 22 is provided on both sides of the paper storage section 11, FIG. 3 and FIG. 4 only illustrate the protruding portion 22 on one of the sides.

Edge guides 20, 21A and 21B are provided inside the paper storage section 11. The edge guide 20 is for guiding the trailing edge of the recording sheet, and the edge guides 21A and 21B are for guiding the respective sides of the recording sheet intersecting the trailing edge.

The paper cassette 10 includes a holding recess 13 formed on the front face, and including an operation lever 31 thereinside, which will be subsequently described. The user can easily draw out the paper cassette 10, simply by operating the operation lever 31.

In addition, a front panel 17 constituting the front face of the paper cassette 10 includes a display window 14, in which a mark indicating the size of the recording sheet to be stored (e.g., A3, A4) is visibly displayed. The mark indicating the size of the recording sheet is shown on a sign plate 15, retained by a plate holder 16 provided on the back of a bulging portion 12. The sign plate 15 is removably placed in the plate holder 16, so that the sign plate 15 can be easily replaced with another one, according to the size of the recording sheet to be stored in the paper cassette 10.

The bulging portion 12 is formed on the front side with respect to the printer 1, in the paper storage section 11.

The bulging portion 12 protrudes to a lateral side of the printer 1 (to the right in this embodiment), from the side of the paper storage section 11.

The display window 14 is located in the bulging portion 12.

The paper cassette 10 is generally configured as above, and hereunder a mechanism for locking and unlocking the paper cassette 10 to and from the apparatus main body 3 will be described, referring also to FIG. 5 and the subsequent drawings.

The paper cassette 10 is configured to be locked to the cassette compartment 8 upon being mounted therein, so that the paper cassette 10 is unable to be drawn out unless being unlocked. The locking of the paper cassette 10 is realized by engaging a lock lever 27 shown in FIG. 5, FIG. 11, and FIG. 12 with an engaging hook 26 shown in FIG. 11 and FIG. 12.

The lock lever 27 and the engaging hook 26 constitute a locking device 25 for locking the paper cassette 10 to the apparatus main body.

Here, although the engaging hook 26 is provided on the side of the apparatus main body 3 (cassette compartment 8), not on the side of the paper cassette 10, in FIG. 11 and FIG. 12 the apparatus main body 3 is omitted and only the engaging hook 26 is shown, for the sake of convenience.

In this embodiment, the lock lever 27 is located on the right side face of the paper storage section 11, at a position close to the front face. The lock lever 27 is pivotable about a first pivotal shaft 34 both clockwise and counterclockwise in FIG. 11 and FIG. 12, so as to be engaged with and disengaged from the engaging hook 26, as will be subsequently described in further detail. Accordingly, the lock lever 27 can be set to a locked state of being engaged with the engaging hook 26 as shown in FIG. 11, and an unlocked state of being disengaged from the engaging hook 26, as shown in FIG. 12. Here, a numeral 11*b* denotes a lever stopper that restricts the pivotal movement of the lock lever 27.

The switching between the locked state and the unlocked state, in other words the pivotal movement of the lock lever 27 (rotation of the first pivotal shaft 34) can be performed by operating the operation lever 31, exemplifying the operation unit in the disclosure, provided on the inner side of the holding recess 13. Referring to FIG. 5 illustrating the paper cassette 10 from which the front panel 17 is removed, the operation lever 31 is disposed so as to slide in the direction in which the paper cassette 10 is mounted and removed (indicated by an arrow E in FIG. 5), with respect to a frontal portion 11*a* of the paper storage section 11.

The movement of the operation lever 31 is converted by a conversion mechanism 30 (see FIG. 6), into the engaging and disengaging movement of the lock lever 27 with respect to the engaging hook 26, in other words the pivotal movement of the lock lever 27 (rotation of the first pivotal shaft 34).

Referring to FIG. 6, the conversion mechanism 30 includes the first pivotal shaft 34 extending in the direction intersecting the displacement direction of the operation lever 31 (in this embodiment, width direction of the printer 1) having the lock lever 27, and a second pivotal shaft 35 extending in the same direction as the first pivotal shaft 34, and to which the first pivotal shaft 34 is fitted so as to rotate in an interlocked manner.

The second pivotal shaft 35 includes lever moving pieces 35*a*, 35*a* (see also FIG. 7) located on the upper side, and configured to make the second pivotal shaft 35 and the first pivotal shaft 34 rotate, upon being pulled by the operation lever 31 toward the front side of the printer 1, so as to cause the lock lever 27 to pivot so as to be disengaged from the engaging hook 26 (counterclockwise in FIG. 6).

The conversion mechanism 30 also includes a compression spring 36 serving as a biasing element that presses an abutment portion 35*b* provided on the lower side of the second pivotal shaft 35 toward the front side of the printer 1, so as to bias the second pivotal shaft 35 and the first pivotal shaft 34 in the direction to cause the lock lever 27 to be engaged with the engaging hook 26, in other words to be set to the locked state (see also FIG. 9).

Figure 7:
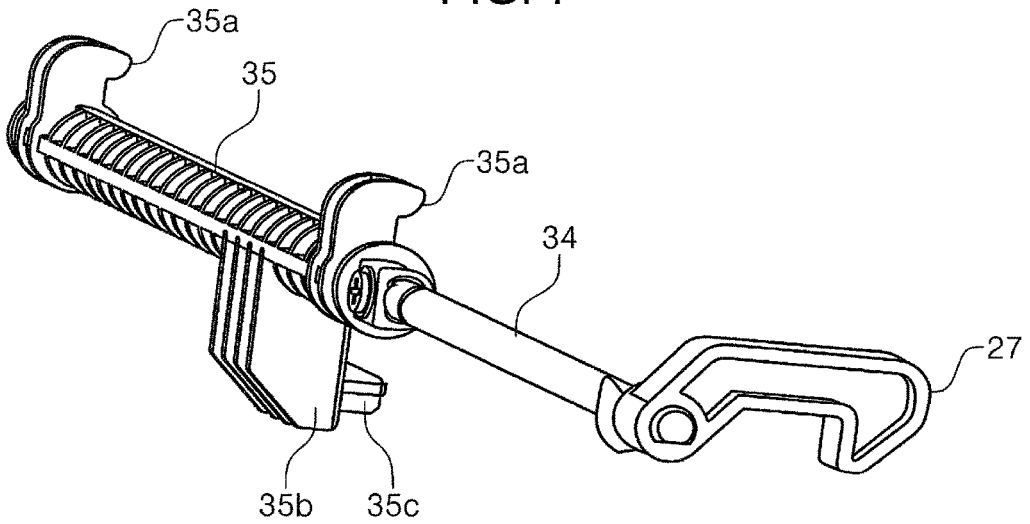
FIG. 7 is a perspective view of a first pivotal shaft, a second pivotal shaft, and a lock lever.

Here, a numeral 35*c* in FIG. 7 denotes a spring fitting portion to which the compression spring 36 is fitted.

As shown in FIG. 6, the operation lever 31 includes arm portions 32, 32 integrally formed therewith, so as to be displaced in an interlocked manner with the operation lever 31. The arm portions 32 each include a lever slot 32*b*, in which the lever moving piece 35*a* is accommodated (see also FIG. 8 and FIG. 10).

Here, FIG. 8 and FIG. 10 are cross-sectional views of the frontal portion of the paper cassette 10 including the conversion mechanism 30, taken at the position corresponding to the lever moving piece 35*a*, along a plane orthogonal to the axial line of the second pivotal shaft 35. In FIG. 8, the front panel 17 is omitted, and in FIG. 10 the front panel 17 and the operation lever 31 are omitted.

FIG. 9 is a cross-sectional view of the frontal portion of the paper cassette 10 including the conversion mechanism 30, taken at the position corresponding to the abutment portion 35*b* and the compression spring 36, along a plane orthogonal to the axial line of the second pivotal shaft 35.

The operation lever 31 is, when not used, biased toward the far side of the printer 1 by the compression spring 36, and is ready to be displaced toward the front side of the printer 1, as shown in FIG. 8.

When the user pulls the operation lever 31 with the hand toward the user, in other words in the direction to draw out the paper cassette 10 (to the left in FIG. 8 to FIG. 10), a lever pressing portion 32*a* of each of the arm portions 32 presses the lever moving piece 35*a* toward the front side of the printer 1, owing to the displacement of the operation lever 31. Accordingly, the second pivotal shaft 35 and the first pivotal shaft 34 are made to rotate counterclockwise in FIG. 8 to FIG. 10, so that the lock lever 27 is disengaged from the engaging hook 26, to be set to the unlocked state (FIG. 10). When the user releases the operation lever 31 from the hand in the unlocked state, the operation lever 31 returns to the initial position, owing to the biasing force of the compression spring 36 (see FIG. 8 and FIG. 9).

Referring now to FIG. 13, the positional relationship between the holding recess 13 in the front face of the paper cassette 10 front face and the operation lever 31 will be described. The operation lever 31 includes an upper holding portion 31*a* located on the inner side of the holding recess 13 and on the upper side thereof, and a lower holding portion 31*b* located on the inner side of the holding recess 13 and on the lower side thereof (see also FIG. 5 and FIG. 9).

Therefore, the user can lock or unlock the paper cassette 10, in other words switch the position of the lock lever 27, whichever of the upper holding portion 31*a* and the lower holding portion 31*b* the user may hold.

Here, how the user engages the fingers with the operation lever 31, exemplifying the operation unit in the disclosure, depends on the height of the user, the posture in the operation, and the habit, and also on the position of the paper cassettes 10 in the height direction, and which of the paper cassettes 10 is to be operated.

As mentioned above, the configuration according to this embodiment allows the user to switch the position of the lock lever 27, whichever of the upper holding portion 31*a* and the lower holding portion 31*b* the user may hold. Therefore, different users can conveniently handle the paper cassettes 10 in various situations.

In addition, the operation lever 31 is located on the inner side of the holding recess 13 and hence not exposed in the front face of the cassette front face. Therefore, the front face of the cassette can be formed in a generally flat shape, and thus an exquisite appearance of the paper cassette 10 can be attained.

In this embodiment, since the upper holding portion 31*a* and the lower holding portion 31*b* are integrally formed with a single operation lever 31, the operation unit can be manufactured at a low cost.

In this embodiment, the state of the lock lever 27 is switched by displacing the operation lever 31 in the mounting and removal direction of the paper cassette 10 (arrow E in FIG. 5) in and from the apparatus main body 3 of the printer 1. Therefore, the user can intuitively and easily operate the operation lever 31, which leads to improved user-friendliness.

In this embodiment, further, the upper holding portion 31*a* and the lower holding portion 31*b* of the operation lever 31 are located in the outer periphery of the holding recess 13 on the rear side thereof.

To be more detailed, a numeral 13*a* in FIG. 13 denotes the upper edge, a numeral 13*b* denotes the lower edge, a numeral 13*c* denotes the right edge, and a numeral 13*d* denotes the left edge of the holding recess 13, and in this embodiment the upper holding portion 31*a* possesses a region on the upper side of the upper edge 13*a*, and the lower holding portion 31*b* possesses a region on the lower side of the lower edge 13*b*.

Numerals A1 and A2 in FIG. 13 respectively denote the regions occupied by the upper holding portion 31*a* and the lower holding portion 31*b*, in the outer periphery of the holding recess 13 on the rear side thereof (hatched portions in FIG. 13), in other words holding margins with which the user can engage the fingers. In this embodiment, such holding margins are provided.

The mentioned configuration allows a larger area to be secured for the holding recess 13, thereby improving the operability, compared with a configuration in which the upper holding portion 31*a* and the lower holding portion 31*b* stick out into the opening of the holding recess 13.

As described above, in this embodiment the operation lever 31 includes the upper holding portion 31*a* located on the upper side and the lower holding portion 31*b* located on the lower side on the inner side of the holding recess 13, however a right holding portion 31*c* and a left holding portion 31*d* may be additionally provided, as shown in FIG. 14.

In FIG. 14, a numeral 310 denotes a variation of the operation lever 31, and numerals B1 and B2 respectively denote the regions occupied by the right holding portion 31*c* and the left holding portion 31*d*, in the outer periphery of the holding recess 13 on the rear side thereof (hatched portions in FIG. 14), which also serve as the holding margins with which the user can engage the fingers.

Such a configuration allows the user to engage the fingers with whichever of the upper, lower, right, and left holding portions in the holding recess 13, thereby further improving the operability for locking and unlocking the paper cassette 10.

Further, the foregoing embodiment may be modified, for example as follows.

(1) Although the operation unit that can be held at the upper or lower position, or upper, lower, right, or left position is provided on the inner side of the holding recess 13 in the foregoing embodiment, the operation unit may be configured so as to be held at a diagonal position, in addition to the upper, lower, right, and left positions. Alternatively, the operation lever 31 may be formed in a circular shape, so that the user can hold the operation lever 31 at any desired position, without limitation to the upper, lower, right, or left position.

(2) Although the foregoing embodiment represents the paper cassette for storing the recording sheet, exemplifying the medium in the disclosure, the configuration according to the embodiment may be applied, without limitation to the paper cassette, to a different structure to be locked and unlocked by operating an operation unit.

Figure 15:
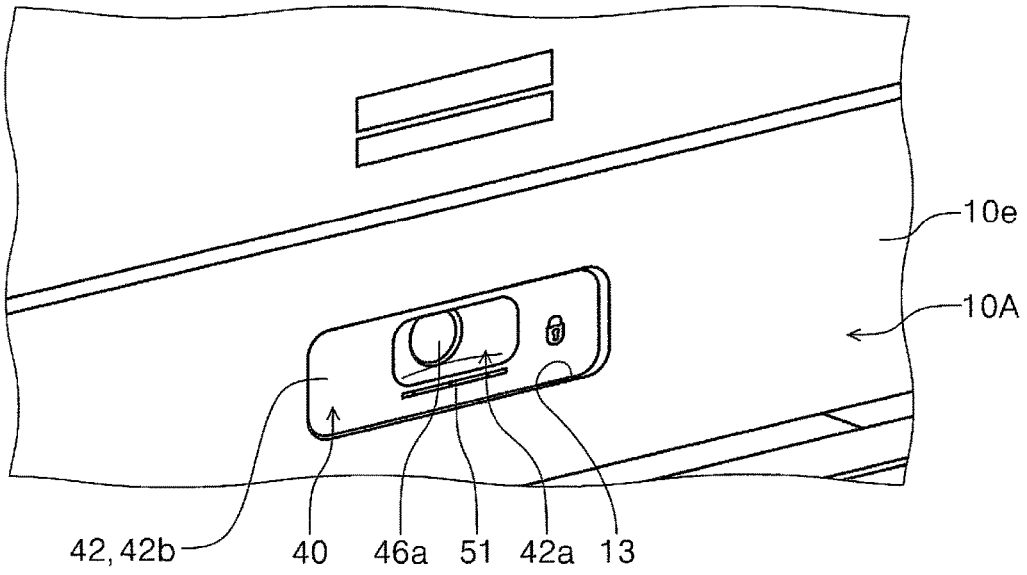
FIG. 15 is a perspective view of the paper cassette with a cover piece attached thereto.

Referring now to FIG. 15 and the subsequent drawings, a cover piece 40 will be described hereunder.

Figure 16:
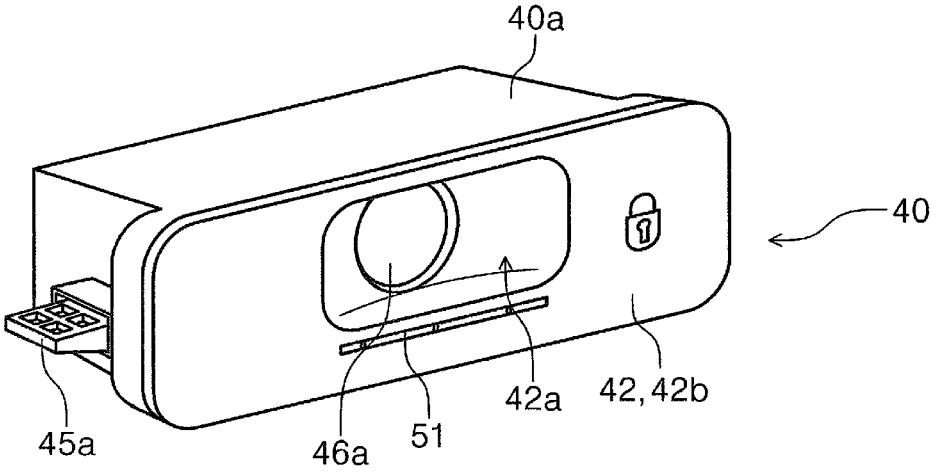
FIG. 16 is a perspective view of the cover piece.
Figure 17:
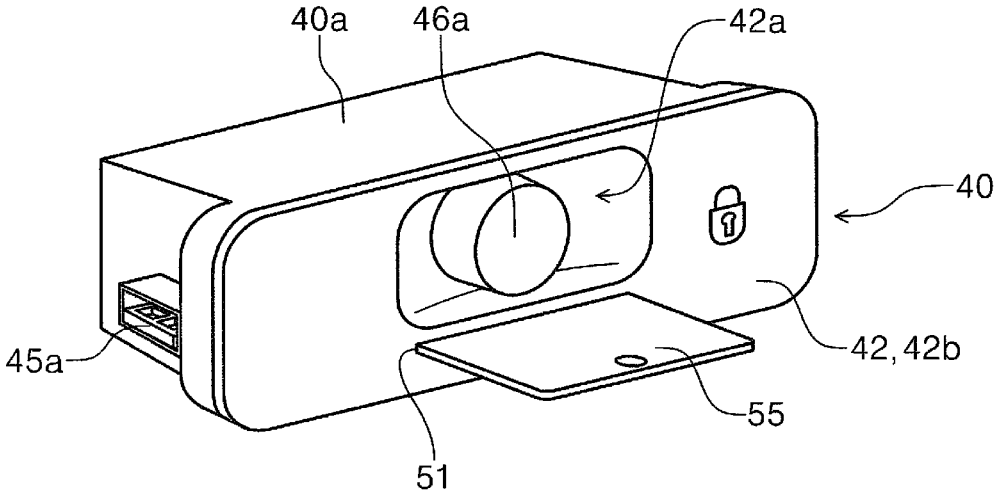
FIG. 17 is a perspective view of the cover piece, with a key member inserted therein.

As shown in FIG. 15 to FIG. 17, the cover piece 40 is removably attached to the holding recess 13 of the paper cassette 10.

The cover piece 40 includes a main portion 40*a* to be fitted in the holding recess 13 so as to cover the holding recess 13, a sliding member 45 for locking (fixing) the main portion 40*a* to the holding recess 13 (in FIG. 16 and FIG. 17, a tip portion 45*a* of the sliding member 45 is illustrated). When the main portion 40*a* is fitted in the holding recess 13, the operation lever 31, exemplifying the operation unit in the disclosure, is restricted from being accessed, in other words the unlocking operation is restricted. The cover piece 40 thus configured prevents inadvertent removal of the paper cassette 10, without incurring an increase in dimensions of the printer 1.

In addition, the sliding movement of the sliding member 45 switches between a first state in which the main portion 40*a* is locked to the holding recess 13 (see FIG. 15 and FIG. 16), and a second state in which the tip portion 45*a* is sticking out from the main portion 40*a* by a shorter length compared with the first state (see FIG. 17), so as to allow the main portion 40*a* to be fitted in or removed from the holding recess 13. Such a sliding movement requires a smaller space for switching the state, compared with, for example, a pivotal movement.

In the removed state shown in FIG. 17, a key member 55 is unremovably inserted in a keyhole (opening) 51 formed in the front face of the cover piece 40, and the cover piece 40 and the key member 55 are stored as a set.

When the cover piece 40 set as above is inserted in the holding recess 13 of the paper cassette 10, and a press button 46*a* (cam 46), provided in a recess 42*a* formed in the central region of the front face of the cover piece 40, is pressed, the tip portion 45*a* of the sliding member 45 sticks out from each of the side faces of the main portion 40*a*, as shown in FIG. 16.

Figure 18:
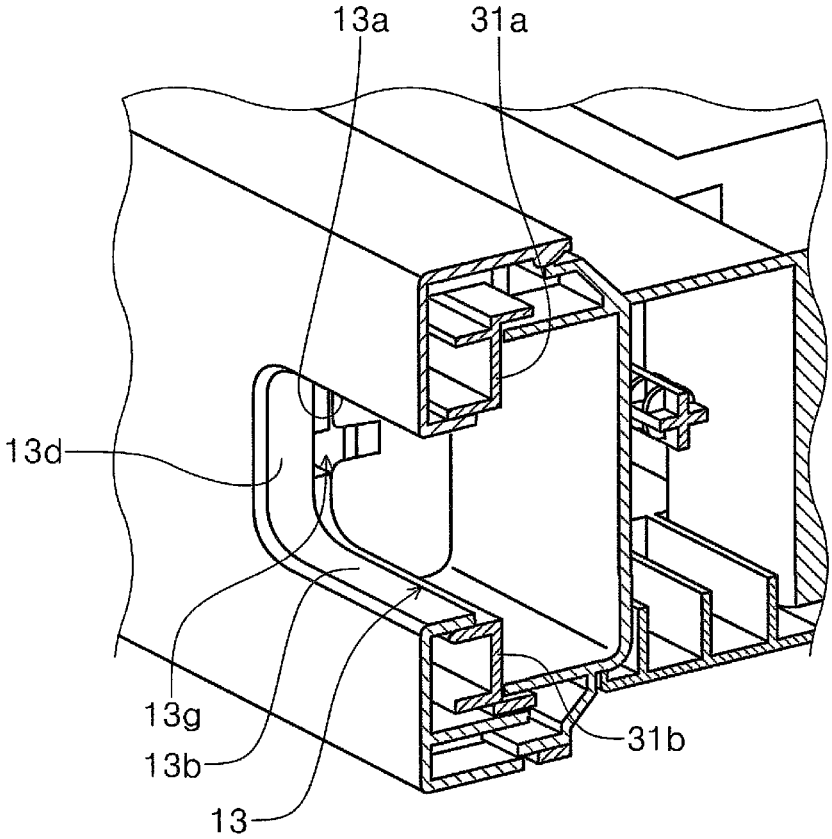
FIG. 18 is a partially cut-away perspective view of the front face of the paper cassette.

The tip portion 45*a* sticking out as above enters an engaging hole 13*g* located in each lateral portion inside the holding recess 13 (see FIG. 18), so that the cover piece 40 is locked to the holding recess 13.

Here, when the press button 46*a* (cam 46) provided in the central region of the front face is pressed, the key member 55 is unlocked from the main portion 40*a*, and can be drawn out from the keyhole 51.

The cover piece 40 generally works as described above.

Hereunder, the configuration of the cover piece 40 will be described in further detail.

Figure 19:
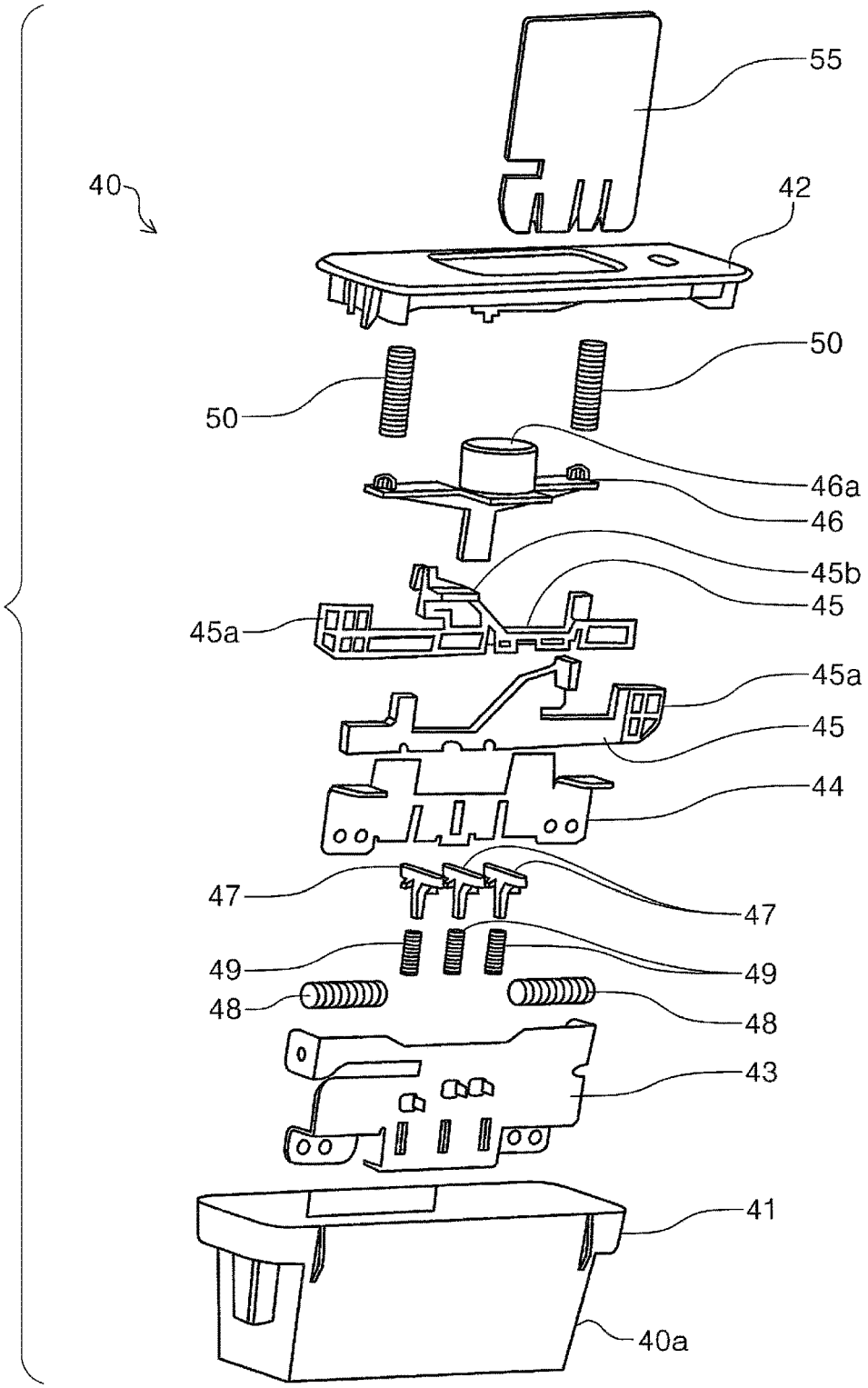
FIG. 19 is an exploded perspective view of the cover piece.

Referring to FIG. 19, the cover piece 40 includes a casing 41 constituting the outer shell of the main portion 40*a*, and a panel portion 42 constituting the front face of the main portion 40*a*. The cover piece 40 also includes, inside the casing 41, a base frame 43, a sub frame 44, two sliding members 45, the cam 46, three lock elements 47, two coil springs 48, three coil springs 49, and two coil springs 50.

A numeral 55 denotes the key member.

Hereinafter, the direction in which the sliding member 45 slides will be simply referred to as left-right direction, and the direction in which the press button 46*a* (cam 46) is pressed and reset will be simply referred to as depth direction. In addition, the direction orthogonal to the surface of the base frame 43 (vertical direction in this embodiment) will be simply referred to as thickness direction.

The sub frame 44 is fixed at a position spaced from the base frame 43 by a predetermined distance in the thickness direction, and the two sliding members 45 and the three lock elements 47 are located between the gap between the sub frame 44 and the base frame 43.

The two sliding members 45 are formed in the same shape, and are oriented in different directions. The two sliding members 45 are interposed between the base frame 43 and the sub frame 44, to be guided in the left-right direction by the base frame 43 and the sub frame 44.

Figure 20:
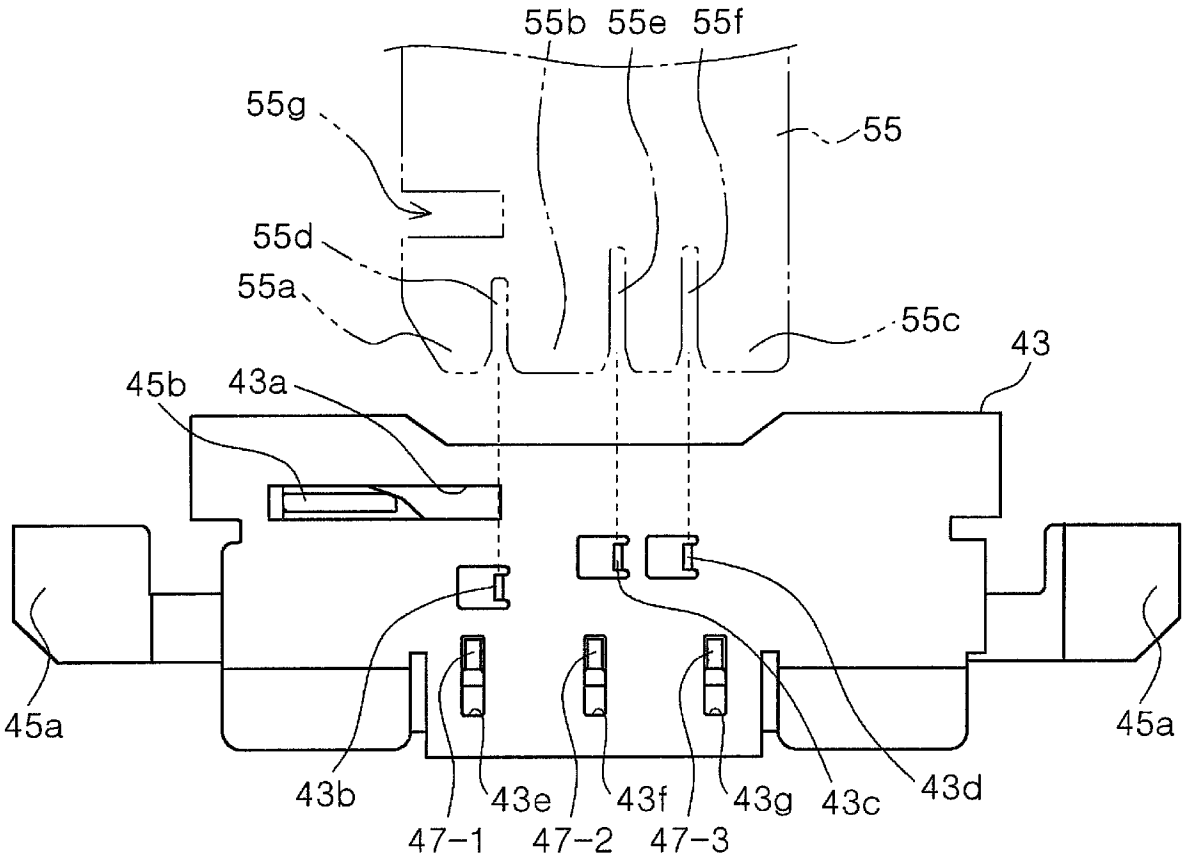
FIG. 20 is a partial plan view showing an essential part inside the cover piece.
Figure 21:
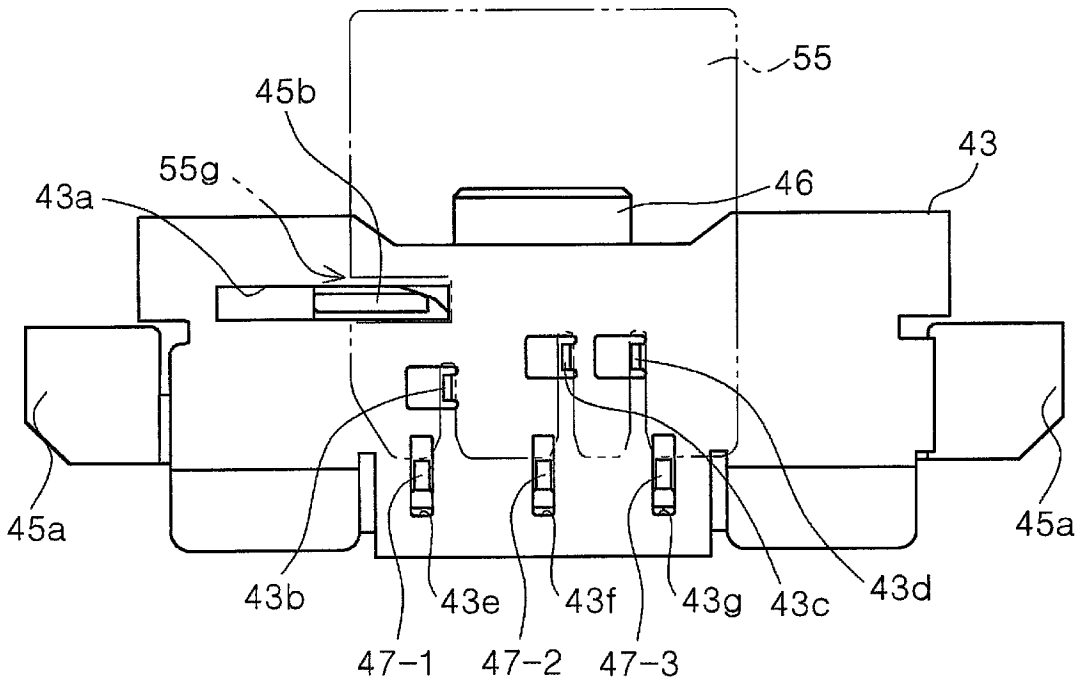
FIG. 21 is a partial plan view showing the essential part inside the cover piece.

The lock elements 47 are each formed generally in T-shape, and are interposed between the base frame 43 and the sub frame 44, to be guided in the depth direction by the base frame 43 and the sub frame 44. Referring to FIG. 20 and FIG. 21, numerals 43*e*, 43*f*, and 43*g* denote the guide grooves formed in the base frame 43, to guide the respective lock elements 47 in the depth direction. The sub frame 44 also includes similar guide grooves, and the lock elements 47, interposed between the base frame 43 and the sub frame 44, each partially stick out from the base frame 43 and the sub frame 44 in the thickness direction. The portion of the lock element 47 sticking out from the base frame 43 in the thickness direction is engaged with the key member 55, as will be subsequently described.

The three lock elements 47 are also engaged with the sliding member 45, to delimit the stroke of the sliding member 45 in the left-right direction. More specifically, the sliding member 45 includes, as shown in FIG. 22 to FIG. 24, a first recess 45*c*, a second recess 45*d*, and a third recess 45*e* aligned in the sliding direction (left-right direction) at predetermined intervals.

The three lock elements 47 are fitted in the respective recesses 45*c* to 45*e*, to thereby maintain the first state of the sliding member 45, in other words the state in which the cover piece 40 is locked to the holding recess 13 (tip portion 45*a* is in the engaging hole 13*g*).

Figure 22:
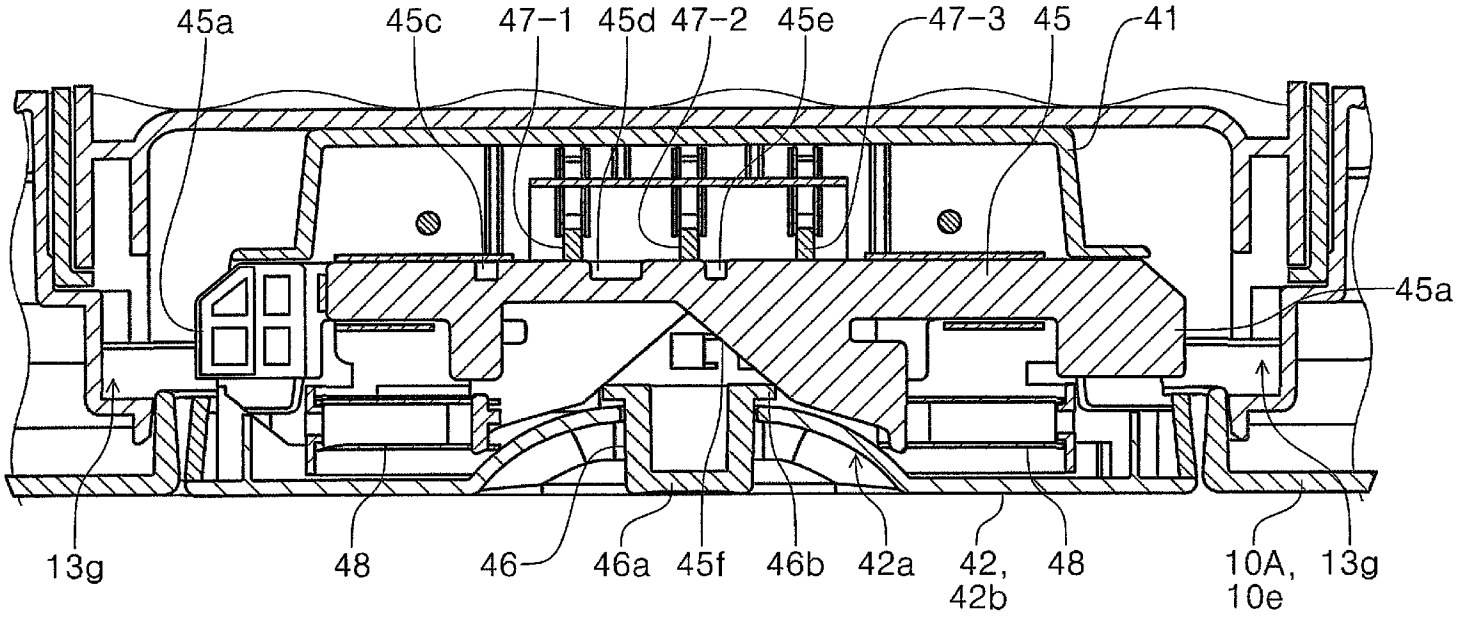
FIG. 22 is a partial cross-sectional view showing an essential part inside the cover piece.
Figure 23:
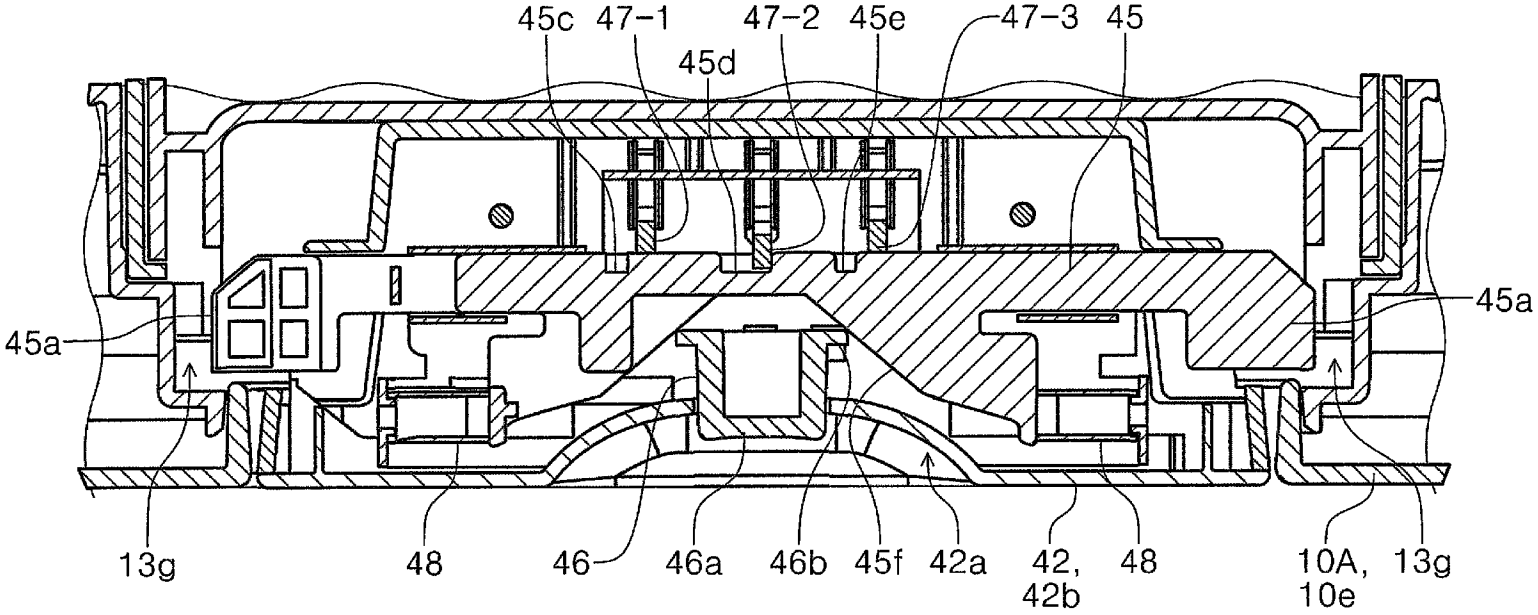
FIG. 23 is a partial cross-sectional view showing the essential part inside the cover piece.
Figure 24:
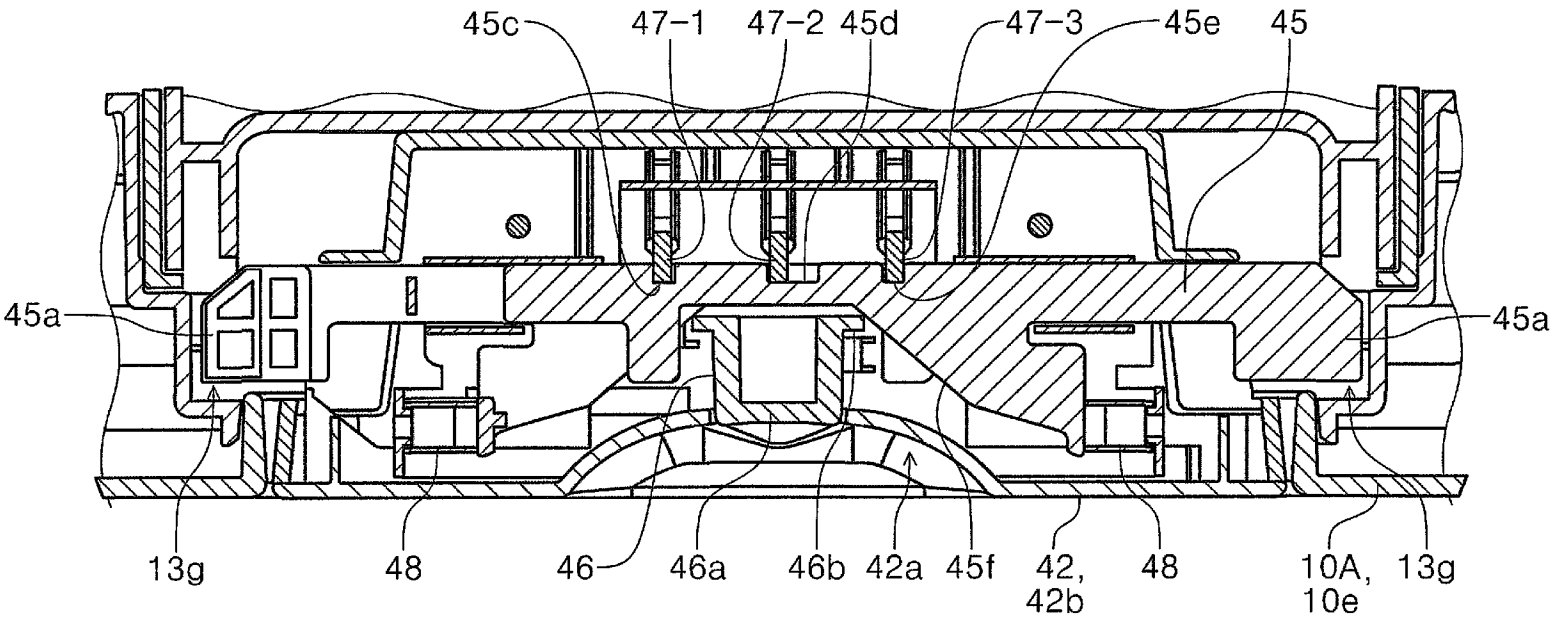
FIG. 24 is a partial cross-sectional view showing the essential part inside the cover piece.

In FIG. 22 to FIG. 24, the lock element engaged with the first recess 45*c* is denoted by a numeral 47-1. Likewise, the lock element engaged with the second recess 45*d* is denoted by a numeral 47-2, and the lock element engaged with the third recess 45*c* is denoted by a numeral 47-3.

The first recess 45*c* and the third recess 45*e* have generally the same width, and the second recess 45*d* is wider than the first recess 45*c* and the third recess 45*e*. In the shifting process of the sliding member 45 from the second state (FIG. 22: unlocked state) to the first state (FIG. 24: locked state), only the lock element 47-2 at the center enters the corresponding second recess 45*d* as shown in FIG. 23, for a reason to be subsequently described.

The cam 46, formed with the press button 46*a*, is guided in the depth direction by the sub frame 44. The cam 46 includes a cam portion 46*b* as shown in FIG. 22 to FIG. 24, which is abutted against a cam surface 45*f* formed on the sliding member 45. When the cam 46 is pressed inward in the depth direction, the cam portion 46*b* displaces the cam surface 45*f*, so as to cause the sliding member 45 to slide in the direction to stick out from the main portion 40*a*.

The coil spring 48 serves to bias the sliding member 45 so as to retreat inwardly of the main portion 40*a*.

The coil spring 49 serves to bias the lock element 47 so as to be pressed against the sliding member 45.

Further, the coil spring 50 serves to bias the cam 46 so as to retreat inwardly of the main portion 40*a*.

Still referring to FIG. 20 and FIG. 21, the relationship between the key member 55 and the three lock elements 47 will be described.

The base frame 43 includes three regulating projections 43*b*, 43*c*, and 43*d* aligned in the left-right direction at predetermined intervals. The regulating projections 43*b*, 43*c*, and 43*d* serve to prevent the three lock elements 47 from being pressed by a wrong key member, thus to serve as counterpart of the key member. Accordingly, the corresponding key member 55 includes three grooves, namely a first groove 55*d*, a second groove 55*e*, and a third groove 55*f*, located so as accommodate the respective regulating projections 43*b*, 43*c*, and 43*d*.

When the key member 55 is inserted in the keyhole 51, the regulating projection 43*b* enters the first groove 55*d*, the regulating projection 43*c* enters the second groove 55*e*, and the regulating projection 43*d* enters the third groove 55*f*. Accordingly, the first engaging portion 55*a* of the key member 55 presses the lock element 47-1, the second engaging portion 55*b* presses the lock element 47-2, and the third engaging portion 55*c* presses the lock element 47-3.

Upon being pressed as above, the lock elements 47 are each released from the corresponding recess (45*c*, 45*d*, or 45*e*) of the sliding member 45, as shown by the transition from FIG. 24 to FIG. 22, to thereby allow the sliding member 45 to slide. Upon being enabled to slide, the sliding member 45 retreats to the inner side in the main portion 40*a*, owing to the biasing force of the coil spring 48. Therefore, the tip portion 45*a* of the sliding member 45 is released from the engaging hole 13*g*, and thus the cover piece 40 is unlocked from the holding recess 13.

At this point, a stopper 45*b* formed on the sliding member 45 enters a receiving groove 55*g* formed in the key member 55, as shown by the transition from FIG. 20 to FIG. 21, to disable the key member 55 from being drawn out. Here, a numeral 43*a* denotes a slot formed in the base frame 43, and the stopper 45*b* formed on the sliding member 45 sticks out from the surface of the base frame 43 through the slot 43*a*, to be engaged with the key member 55.

In the mentioned state, which is shown in FIG. 21, the cover piece 40 can be inserted in the holding recess 13. When the press button 46*a* (cam 46) is pressed after the cover piece 40 is inserted in the holding recess 13, the sliding member 45 is caused to slide, so as to release the stopper 45*b* from the receiving groove 55*g* of the key member 55, thereby enabling the key member 55 to be drawn out (state of FIG. 20).

Now, the removal of the key member 55 theoretically means that the cover piece 40 has been locked to the holding recess 13. However, from the viewpoint of the dimensional accuracy of the components, the stopper 45*b* may escape from the receiving groove 55*g* of the key member 55 despite that the locking has not been completed, so as to enable the key member 55 to be drawn out.

Therefore, the cover piece 40 according to this embodiment includes a two-stage locking mechanism. Among the three recesses 45*c*, 45*d*, and 45*e* of the sliding member 45, described above referring to FIG. 22 to FIG. 24, the second recess 45*d* at the center is wider than the first recess 45*c* and the third recess 45*e* on the respective sides. This is for allowing the lock element 47-2 to first enter the second recess 45*d* when the press button 46*a* (cam 46) is pressed, as shown by the transition from FIG. 22 to FIG. 23.

In other words, the three lock elements 47 are engaged with the sliding member 45 at different timings, instead of at the same timing, when the press button 46*a* (cam 46) is pressed. In this embodiment, first the lock element 47-2 enters the second recess 45*d*, and when the cam 46 is pressed further inward, the remaining lock elements 47-1 and 47-3 respectively enters the first recess 45*c* and the third recess 45*e*.

According to the design, at the time point that the lock element 47-2 has first entered the second recess 45*d*, the stopper 45*b* formed on the sliding member 45 starts to enter the receiving groove 55*g* formed in the key member 55.

Therefore, even though the stopper 45*b* formed on the sliding member 45 has not entered the receiving groove 55*g* formed in the key member 55 at this point, owing to fluctuation in dimensional accuracy of the components, and hence the key member 55 is drawn out, the lock element 47-2, out of the three lock elements, has already entered the second recess 45*d*, and therefore the locked state of the cover piece 40 to the holding recess 13 is properly maintained. When the press button 46*a* (cam 46) is further pressed in such a state, the remaining lock elements 47-1 and 47-3 also enter the respective recesses 45*c* and 45*e*, to complete the locked state.

The mentioned two-stage locking mechanism prevents the key member 55 from being drawn out, despite that the locking of the cover piece 40 to the holding recess 13 has not been completed.

As described thus far, the cover piece 40 according to this embodiment includes the main portion 40*a* configured to enter the holding recess 13 in the paper cassette 10 so as to cover the holding recess 13, and the sliding member 45 configured to lock the main portion 40*a* to the holding recess 13. When the main portion 40*a* is fitted in the holding recess 13, the operation of the operation lever 31, in other words the operation to unlock the paper cassette 10, is restricted. Thus, the locked state can be secured without allowing the cover piece 40 to remarkably protrude from the paper cassette 10, and therefore an increase in dimensions of the printer 1 can be suppressed, and yet inadvertent removal of the paper cassette 10 can be prevented.

In the cover piece 40, the first state of the sliding member 45 (main portion 40*a* of the cover piece 40 is locked to the holding recess 13) is realized when the tip portion 45*a* of the sliding member 45 is engaged with the engaging hole 13*g* formed inside the holding recess 13. Therefore, the main portion 40*a* can be securely locked to the holding recess 13.

In the cover piece 40, in addition, the sliding member 45 switches between the first state and the second state (barely sticking out from the main portion 40*a* and the main portion 40*a* can be inserted in or removed from the holding recess 13), by sliding in the left-right direction of the holding recess 13 (width direction of the paper cassette 10). The mentioned sliding movement requires a smaller space for switching the state, compared with, for example, a pivotal movement.

The cover piece 40 includes the press button 46*a* (cam 46) that can be displaced in the depth direction of the holding recess 13 (insertion and removal direction of the paper cassette 10), and the sliding member 45 switches the second state to the first state when the cam 46 is pressed. Therefore, the second state can be easily switched to the first state, with a simple operation.

The cover piece 40 also includes the keyhole 51, which is the opening for inserting the key member 55, and the sliding member 45 switches the first state to the second state when the key member 55 is inserted in the keyhole 51. Therefore, the first state can be easily switched to the second state, with a simple operation.

Further, in the cover piece 40, the operation lever 31, exemplifying the operation unit, may be restricted from being displaced, when the main portion 40*a* is in the holding recess 13, and the sliding member 45 is set to the first state.

Figure 25:
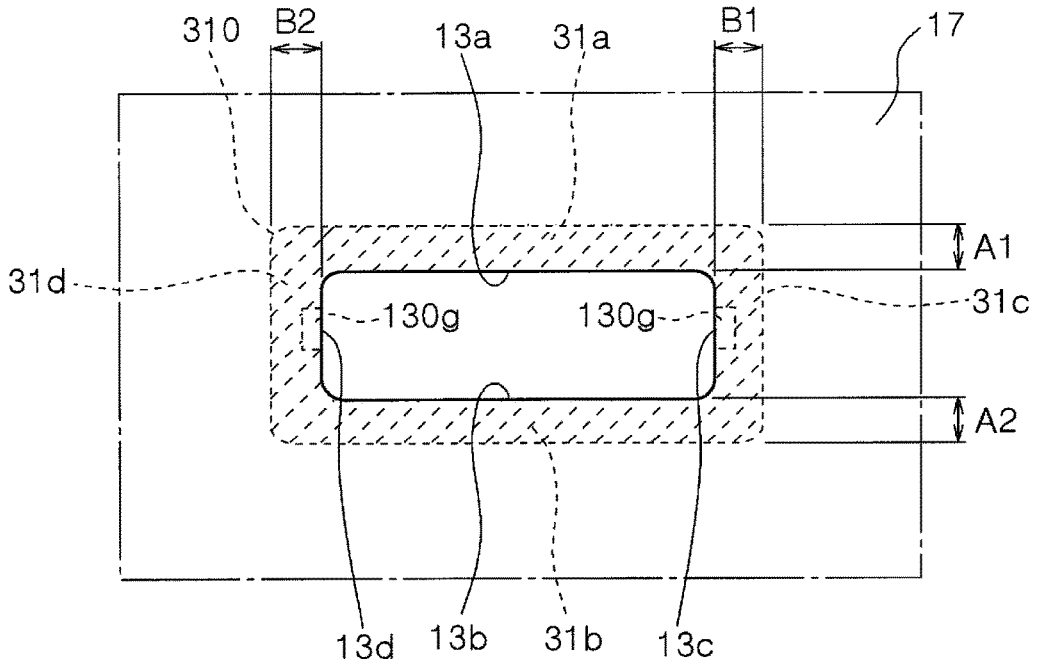
FIG. 25 is a front view of a holding recess according to another variation of the embodiment.

More specifically, as shown in FIG. 25 illustrating a variation of FIG. 14, an engaging hole 130*g* serving as a restriction hole may be formed in each of the right holding portion 31*c* and the left holding portion 31*d*, which are intermediate portions connecting the upper holding portion 31*a* and the lower holding portion 31*b*, to allow the tip portion 45*a* of the sliding member 45 to enter the engaging hole 130*g*.

In this case, the paper cassette 11 is prevented from being accidentally unlocked from the apparatus main body 3, owing to vibration or an impact.

Here, it is not mandatory that the engaging hole 130*g* is formed in the right holding portion 31*c* and the left holding portion 31*d*. The engaging hole 130*g* may be formed in the upper holding portion 31*a* or the lower holding portion 31*b*. Alternatively, instead of forming the right holding portion 31*c* and the left holding portion 31*d*, the intermediate portion connecting the upper holding portion 31*a* and the lower holding portion 31*b* may be utilized as it is, to form therein the engaging hole 130*g*. In this case, the cover piece 40 can be operated more comfortably, compared with the case where the engaging hole is formed in the operation unit.

Further, the cover piece 40 according to this embodiment includes the panel portion 42 having a shape and size that accord with the inner contour of the holding recess 13, and the surface 42*b* of the panel portion 42 and the front face 10*e* of the paper cassette 10 are generally flush with each other, when the main portion 40*a* covers the holding recess 13, as shown in FIG. 15.

Therefore, the appearance of the paper cassette 10 can be improved, and an increase in size of the paper cassette 10 can be prevented, despite the cover piece 40 being attached to the paper cassette 10.

The cover piece 40 thus far described may be modified as follows.

(1) In the foregoing embodiment, the key member 55 is restricted from being drawn out from the cover piece 40 when the cover piece 40 is removed from the holding recess 13 of the paper cassette 10. However, the key member 55 may be allowed to be drawn out from the cover piece 40, in the mentioned state.

(2) The press button 46*a* (cam 46) of the cover piece 40 may be configured to displace the operation lever 31, upon being pressed inward, either directly or indirectly via another component, to thereby engage the lock lever 27 (see FIG. 11) with the engaging hook 26 (see FIG. 11), in other words set the lock lever 27 to the locked state.

(3) Although two sliding members 45 are provided so as to stick out in both left and right directions in this embodiment, only one sliding member 45 may be provided, so as to stick out in either direction. However, when the two sliding members 45 stick out in both left and right directions as in this embodiment, the cover piece 40 can be more stably attached.

The sliding members 45 may be configured so as to stick out in the up-down direction, instead of the left-right direction. Further, the sliding members 45 may stick out in all directions, namely upward, downward, to the left, and to the right.

(4) When a plurality of paper cassettes 10 are provided (in this embodiment, four paper cassettes 10A to 10D), the cover piece 40 may be attached to one or more selected paper cassettes, or to all of the paper cassettes.

In this case, a single key member 55 may be prepared for a plurality of cover pieces 40 in common, to unlock all the cover pieces 40 with the single key member, or for a selected ones of the cover pieces 40 in common. Alternatively, different key members may be prepared for the respective cover pieces 40.

(5) Although cover piece 40 is applied to the paper cassette in this embodiment, the cover piece 40 may be applied, without limitation to the paper cassette, to a different structure including an operation unit for locking and unlocking a mounted state, and a recess in which the operation unit is located.

What is claimed is:

1. A cover piece to be removably attached to a medium storage cassette including a medium storage section for storing a medium, and an operation unit provided in a recess and configured to lock and unlock the medium storage section to and from an apparatus main body, the cover piece comprising:

a main portion configured to enter the recess in the medium storage cassette so as to cover the recess;

a sliding portion configured to slide so as to switch between a first state in which the sliding portion sticks out from the main portion and the main portion is locked to the recess, and a second state in which the main portion is unlocked and allowed to enter the recess and be removed from the recess; and an opening for receiving a key member, wherein the sliding portion switches the first state to the second state, when the key member is inserted in the opening, wherein the key member unmovable from the opening, and the cover piece is detachable together with the key member from the recess, when the second state.

2. The cover piece according to claim 1, wherein the first state of the sliding portion is realized when a tip portion of the sliding portion is engaged with an engaging hole formed inside the recess.

3. The cover piece according to claim 1, wherein the sliding portion is configured to switch between the first state and the second state, by sliding in a width direction of the medium storage cassette in the recess.

4. The cover piece according to claim 1, further comprising a press button that can be displaced in a depth direction of the recess, wherein the sliding portion switches the second state to the first state, when the press button is pressed.

5. The cover piece according to claim 1, further comprising an opening for receiving a key member, wherein the sliding portion switches the first state to the second state, when the key member is inserted in the opening.

6. The cover piece according to claim 1, wherein the operation unit is restricted from being displaced in the recess by the sliding portion, when the main portion is in the recess and the sliding portion is set to the first state.

7. The cover piece according to claim 6, wherein the operation unit includes an upper holding portion located on an inner side of the recess and on an upper side thereof, a lower holding portion located on the inner side of the recess and on a lower side thereof, and an intermediate portion connecting the upper holding portion and the lower holding portion, and the operation unit is restricted from being displaced when the tip portion of the sliding portion enters a restriction hole formed in the intermediate portion.

8. The cover piece according to claim 1, wherein the recess is formed in a front face of the medium storage cassette, on a forward side in a direction in which the medium storage cassette is drawn out from the apparatus main body, the main portion includes a panel portion formed on a front side of the medium storage cassette, in a shape and size that accord with an inner contour of the recess, and a surface of the panel portion and the front face of the medium storage cassette become flush with each other, when the main portion covers the recess.

9. A medium storage cassette comprising:

a medium storage section for storing a medium;

an operation unit configured to lock and unlock the medium storage section to and from an apparatus main body;

a recess in which the operation unit is located; and a cover piece including a main portion configured to enter the recess so as to cover the recess, and a sliding portion configured to slide so as to switch between a first state in which the sliding portion sticks out from the main portion and the main portion is locked to the recess, and a second state in which the main portion is unlocked and allowed to enter the recess and be removed from the recess.

10. A cover piece to be removably attached to a medium storage cassette including a medium storage section for storing a medium, and an operation unit provided in a recess and configured to lock and unlock the medium storage section to and from an apparatus main body, the cover piece comprising:

a main portion configured to enter the recess in the medium storage cassette so as to cover the recess; and a sliding portion configured to slide so as to switch between a first state in which the sliding portion sticks out from the main portion and the main portion is locked to the recess, and a second state in which the main portion is unlocked and allowed to enter the recess and be removed from the recess, wherein the operation unit is restricted from being displaced in the recess by the sliding portion, when the main portion is in the recess, and the sliding portion is set to the first state.

11. The cover piece according to claim 10, wherein the operation unit includes an upper holding portion located on an inner side of the recess and on an upper side thereof, a lower holding portion located on the inner side of the recess and on a lower side thereof, and an intermediate portion connecting the upper holding portion and the lower holding portion, and the operation unit is restricted from being displaced when the tip portion of the sliding portion enters a restriction hole formed in the intermediate portion.

* * * * *